US012305247B2

(12) United States Patent
Nishida et al.

(10) Patent No.: US 12,305,247 B2
(45) Date of Patent: May 20, 2025

(54) STAINLESS STEEL SHEET AND METHODS FOR MANUFACTURING THE SAME

(71) Applicant: JFE Steel Corporation, Tokyo (JP)

(72) Inventors: Shuji Nishida, Tokyo (JP); Ayako Ta, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 67 days.

(21) Appl. No.: 18/272,625

(22) PCT Filed: Dec. 9, 2021

(86) PCT No.: PCT/JP2021/045308
§ 371 (c)(1),
(2) Date: Jul. 17, 2023

(87) PCT Pub. No.: WO2022/163160
PCT Pub. Date: Aug. 4, 2022

(65) Prior Publication Data

US 2024/0360529 A1 Oct. 31, 2024

(30) Foreign Application Priority Data

Jan. 29, 2021 (JP) ..... 2021-012754

(51) Int. Cl.

| | |
|---|---|
| ***C21D 8/02*** | (2006.01) |
| ***B21B 1/22*** | (2006.01) |
| ***C21D 9/46*** | (2006.01) |
| ***C22C 38/60*** | (2006.01) |

(52) U.S. Cl.
CPC ..... *C21D 8/0236* (2013.01); *B21B 1/22* (2013.01); *C21D 8/0242* (2013.01); *C21D 8/0278* (2013.01); *C21D 9/46* (2013.01); *C22C 38/60* (2013.01)

(58) Field of Classification Search
CPC ... C21D 8/0236; C21D 8/0278; C21D 8/0242
USPC ..... 428/687
See application file for complete search history.

(56) References Cited

FOREIGN PATENT DOCUMENTS

| | | | | |
|---|---|---|---|---|
| DE | 102017119437 | A1 * | 3/2018 | ..... C22C 38/002 |
| EP | 3 480 329 | A1 | 5/2019 | |
| JP | 06179002 | A | 6/1994 | |
| JP | 08309405 | A | 11/1996 | |
| JP | H09-155404 | A | 6/1997 | |
| JP | 2001001006 | A | 1/2001 | |
| JP | 2001335997 | A | 12/2001 | |
| JP | 2017179519 | A | 10/2017 | |
| JP | 2020111792 | A | 7/2020 | |

OTHER PUBLICATIONS

Li et al., DE102017119437A1 Google Patents Machine translation printed on Mar. 5, 2024, Mar. 1, 2018, entire translation (Year: 2018).*

Korzynski et al., "Experimental Models and Correlations between Surface Parameters after Slide Diamond Burnishing", "Measurement Science Review" May 14, 2018, URL <https://intapi.sciendo.com/pdf/10.1515/msr-2018-0018>, pp. 123-129 (Year: 2018).*

Blateyron, "The Areal Field Parameters", Research Gate, Jun. 2013, URL: <https://www.researchgate.net/publication/260704735_The_Areal_Field_Parameters>, pp. 15-43 (Year: 2013).*

Das et al., ("Evaluation and systemic selection of significant multi-scale surface roughness parameters (SRPs) as process monitoring index", Journal of Materials Processing Technology, 2017, URL: <https://www.sciencedirect.com/science/article/pii/S0924013617300171>, pp. 157-165 (Year: 2017).*

Krolczyk et al, "Influence of Cutting Parameters on Surface Morphology of Austenitic Stainless Steel after Turning", Applied Mechanics and Materials vol. 657, 2014, URL: <https://citeseerx.ist.psu.edu/document?repid=rep1&type=pdf&doi=08847e5758afe352da00604ca5f04fe0d63945d9>, pp. 23-27 (Year: 2014).*

The extended European Search Report issued May 3, 2024, by the European Patent Office in corresponding European Patent Application No. 21923165.1-1103. (8 pages).

International Search Report and Written Opinion for International Application No. PCT/JP2021/045308, dated Jan. 25, 2022, 5 pages.

* cited by examiner

*Primary Examiner* — Katherine A Christy
(74) *Attorney, Agent, or Firm* — Buchanan Ingersoll & Rooney PC

(57) ABSTRACT

A stainless steel sheet has a surface quality in which a core height Sk is 1.50 μm or less, a reduced peak height Spk is 0.20 μm or less, and an areal material ratio Smr2 that separates a reduced dale from a core is 80% or less, where the core height Sk, the reduced peak height Spk, and the areal material ratio Smr2 are as specified in JIS B 0681-2: 2018. The stainless steel sheet has a whiteness of 50 or greater and an image clarity of 1% or greater.

3 Claims, No Drawings

STAINLESS STEEL SHEET AND METHODS FOR MANUFACTURING THE SAME

CROSS REFERENCE TO RELATED APPLICATIONS

This is the U.S. National Phase application of PCT/JP2021/045308, filed Dec. 9, 2021, which claims priority to Japanese Patent Application No. 2021-012754, filed Jan. 29, 2021, the disclosures of these applications being incorporated herein by reference in their entireties for all purposes.

FIELD OF THE INVENTION

The present invention relates to a stainless steel sheet and methods for manufacturing the same and, in particular, to a stainless steel sheet having high whiteness and high image clarity.

BACKGROUND OF THE INVENTION

Stainless steel sheets are widely and frequently used in visually conspicuous members and locations, such as sinks, outer panels of commercial refrigerators, and wall surfaces of buildings. In recent years, these stainless steel sheets have been required to have a high surface quality, particularly from the standpoint of aesthetic properties. In particular, surfaces that are relatively white and reflect clearly and distinctly viewable images of a person or an object are increasingly needed because such surfaces have a soft appearance. That is, there is a need for a stainless steel sheet having high whiteness and high image clarity.

Examples of stainless steel sheets that have been proposed with an emphasis on aesthetic properties are as follows. Patent Literature 1 discloses "a stainless steel sheet having excellent corrosion resistance, in which polishing marks are present in a longitudinal direction on a surface of a ferritic stainless steel sheet; a pitting potential is 0.6 V or greater; a gloss at 60° is 75 or less; a composition contains C: 0.020 mass % or less, Si: 0.40 mass % or less, Mn: 0.40 mass % or less, Cr: 25.00 to 32.00 mass %, Mo: 1.00 to 4.00 mass %, P: 0.030 mass % or less, S: 0.020 mass % or less, Ni: 0.50 mass % or less, and N: 0.020 mass % or less with the balance being Fe and incidental impurities; and a pitting corrosion resistance index (PI=Cr mass %+3Mo mass %) is 30 or greater".

Patent Literature 2 discloses "an aesthetic stainless steel sheet having high whiteness and anti-glare properties, in which at least one surface has a surface gloss of 20 or less in terms of a specular gloss at 60° as specified in JIS Z 8741 and has a lightness of 70 or greater in terms of the L* value as specified in JIS Z 8731".

Patent Literature 3 discloses "a ferritic stainless steel sheet in which a chemical composition contains, in mass %, C: 0.020 to 0.120%, Si: 0.10 to 1.00%, Mn: 0.10 to 1.00%, Ni: 0.01 to 0.60%, Cr: 14.00 to 19.00%, N: 0.010 to 0.050%, Al: 0 to 0.050%, Ti: 0 to 0.050%, Mo: 0 to 0.50%, Cu: 0 to 0.50%, Co: 0 to 0.10%, and V: 0 to 0.20%, with at least one selected from the group of Al: 0.005 to 0.030% and Ti: 0.005 to 0.030% being included, with the balance being Fe and incidental impurities, and the chemical composition has a γ max value, defined by equation (1) below, of 30 to 55, wherein a specular gloss at 20° of a surface of the steel sheet is 900 or greater, and an elongation at break in a rolling direction is 28.0% or greater:

$$\gamma\ max=420C-11.5Si+7Mn+23Ni-11.5Cr-12Mo+9Cu-49Ti-52Al+470N+189 \quad (1)$$

In equation (1), the element symbols are to be substituted with contents in mass % of the respective corresponding elements, and in the instance where an element is absent, the element symbol is to be substituted with 0 (zero)".

PATENT LITERATURE

PTL 1: Japanese Unexamined Patent Application Publication No. 2017-179519

PTL 2: Japanese Unexamined Patent Application Publication No. 2001-335997

PTL 3: Japanese Unexamined Patent Application Publication No. 2020-111792

SUMMARY OF THE INVENTION

Gloss and whiteness, which are indices for evaluating aesthetic properties that have been frequently used in the related art, are, respectively, an index determined from an intensity of the specularly reflected component of light incident on the steel sheet and an index determined from an intensity of the diffusely reflected component of the light. With only these indices, it is impossible to evaluate image clarity, which affects the aesthetic properties of steel sheets.

This is because image clarity is an index associated with the specularly reflected component of light that is incident on a steel sheet from a particular direction, and the index is one that increases when the directions of travel of the component are concentrated. The gloss, which is an index used in the related art, corresponds to a total amount of a component of light that is incident on a steel sheet from a particular direction, and the component is one that is reflected within a specific angle range. Accordingly, the degree of variance of the reflection angles of the specularly reflected light (in other words, the degree of concentration of the directions of travel of the specularly reflected light) does not affect the gloss as long as the specularly reflected light is within the "specific angle range".

However, the above-described degree of variance of the reflection angles of the specularly reflected light (in other words, the degree of concentration of the directions of travel of specularly reflected light) significantly affects the image clarity of steel sheets. That is, even in instances where specularly reflected light is within the "specific angle range", if the variance of the angles of the specularly reflected light is large (in other words, the directions of travel of the specularly reflected light vary), image clarity decreases, and on the other hand, if the variance of the angles is small, image clarity increases.

The stainless steel sheets described in Patent Literature 1 and 2 are ones that have increased anti-glare properties, which are achieved by providing polishing marks on a surface or providing irregularities by treating a surface with acid. With the technology disclosed in Patent Literature 1 or 2, it is possible to produce a steel sheet having low gloss and high whiteness; however, a problem arises in that the resulting steel sheet has low image clarity.

Furthermore, with the technology disclosed in Patent Literature 3, it is possible to produce a steel sheet having high gloss and high image clarity; however, a problem arises in that the resulting steel sheet has low whiteness.

As described, in the related art, the evaluation of the aesthetic properties of stainless steel sheets is performed primarily based on the gloss and whiteness, and sufficient studies have not been conducted on the image clarity, which significantly affects aesthetic properties. In addition, there are no stainless steel sheets that have been developed to have both high whiteness and high image clarity. Accordingly, there is a need for the development of a steel sheet having both high whiteness and high image clarity.

Aspects of the present invention have been made in view of the above-described circumstances, and an object according to aspects of the present invention is to provide a stainless steel sheet having high whiteness and high image clarity.

Another object according to aspects of the present invention is to provide methods for manufacturing the stainless steel sheet.

As referred to herein, the whiteness is a lightness (L* value) as measured in accordance with JIS Z 8722. Specifically, the whiteness is measured in the following manner. A color measurement is performed in accordance with JIS Z 8722:2009 in a manner such that the measurement direction is a rolling direction (L-direction) of a steel sheet. A 10-degree field of view is employed, and a D65 light source is used. The color system to be used is the CIELAB (L*a*b* system). The measurement is performed under Condition c (de: 8°) (SCE condition) to determine the L* value as the whiteness.

The image clarity is C (0.25) as measured in accordance with JIS K 7374. Specifically, the image clarity is measured in the following manner in accordance with JIS K 7374: 2007. Image sharpness (%) is measured to determine C (0.25) as the image clarity. The conditions for the measurement are as follows: the measurement direction is a direction (C-direction) orthogonal to the rolling direction of the steel sheet, which means that the L-direction is orthogonal to the slits of an optical comb; a reflection method is used; a measurement angle is 60°; and a 0.25 mm slit width of the optical comb is employed.

To achieve the objects mentioned above, the present inventors diligently conducted studies and made the following findings.

A requirement for obtaining a surface having high whiteness and high image clarity is that a surface microtopography of the steel sheet is configured such that planar portions for increasing image clarity and recessed portions for increasing whiteness both exist on the surface of the steel sheet. For example, an effective way is to finely distribute recessed portions in planar portions. Specifically, this can be achieved by ensuring that the following surface quality parameters, as determined in accordance with JIS B 0681-2:2018, fall within the respective ranges shown below.

Core height Sk: 1.50 μm or less

Reduced peak height Spk: 0.20 μm or less

Areal material ratio Smr2 that separates a reduced dale from a core: 80% or less The surface quality parameters mentioned above can be determined in the following manner.

Three-dimensional topographical data is one in which the heights (denoted as "c") at different positions are linked to respective X-Y positions. An "areal material ratio curve" is a curve obtained by generating a graph by plotting the height c on the vertical axis and the areal material ratio (0 to 100%) on the horizontal axis, where the "areal material ratio" means an area ratio of a region having heights equal to or greater than a height c. On the areal material ratio curve, a position corresponding to a secant line having a minimum slope is referred to as a central portion of the areal material ratio curve, the secant line being among those corresponding to a difference of 40% in the areal material ratio that are drawn on the areal material ratio curve. A straight line based on which the sum of the squares of deviations in the vertical axis direction is a minimum in the central portion (a width of 40 pt %) is referred to as an equivalent line.

The difference between the heights of the equivalent line at the areal material ratios of 0% and 100% is the core height Sk. Furthermore, regarding regions having heights equal to or greater than the height at the areal material ratio of 0% of the equivalent line, a value is determined by averaging the differences between the respective heights at the respective regions and the height at the areal material ratio of 0% of the equivalent line and then doubling the average. This value is the reduced peak height Spk. Furthermore, the area ratio (%) of regions having heights equal to or greater than the height at the areal material ratio of 100% of the equivalent line is the areal material ratio Smr2 that separates a reduced dale from a core.

That is, the core height Sk is, microscopically, an index of surface roughness of a portion of a surface that has heights relatively close to one another, which, macroscopically, is a portion that causes specular reflection of light. A low Sk (a small Sk value) means that the roughness of a portion of a surface that has heights relatively close to one another is low, that is, a low Sk means that the directions in which specular reflection of light incident from a particular direction occurs tend to be concentrated. "The directions in which specular reflection of light incident from a particular direction occurs are concentrated" means, macroscopically, that image clarity is high. Accordingly, a low Sk is a necessary condition for high image clarity.

The reduced peak height Spk is, microscopically, an index of surface roughness of a portion that has relatively high heights. In some cases, a surface having a low Sk has a high Spk. This means that a large number of waviness components exist in the portion described above that causes specular reflection of light. In the instance where the Sk is low, but the Spk is high, a portion of a surface that has heights relatively close to one another has a low surface roughness but has a high surface waviness. Accordingly, in instances where the Spk is high, even if the Sk is low, the directions in which specular reflection of light incident from a particular direction occurs tends not to be concentrated, and, consequently, macroscopically, image clarity is low. That is, when the Sk is low, and the Spk is low (the Spk value is small), high image clarity is realized.

The areal material ratio Smr2 that separates a reduced dale from a core is, microscopically, an index of an area ratio of a portion that has relatively low heights. A low Smr2 (a small Smr2 value) means that the area ratio of a portion that has relatively low heights is high. The portion that has relatively low heights on a surface having a low Sk and a low Spk is, microscopically, a portion that causes diffuse reflection of light. In instances where the Smr2 is low, diffuse reflection of light occurs to a large extent, and, consequently, macroscopically, whiteness increases.

The present inventors conducted further studies regarding processes for manufacturing stainless steel sheets that can enable the above-described surface quality parameters (Sk, Spk, and Smr2) to fall within the desired ranges.

As a result, the present inventors discovered that an effective way to enable all the above-described surface quality parameters to fall within the desired ranges is to perform a roughening step and a flattening step in this order, each under appropriate conditions.

First, the roughening step is to be performed under appropriate conditions to roughen the surface of a stainless steel sheet. Consequently, the steel sheet has a surface microtopography having a high Sk and a high Spk. Macroscopically, the resulting surface has high whiteness and low image clarity.

Subsequently, the flattening step is to be performed under appropriate conditions to partially flatten the surface of the steel sheet. Accordingly, a surface quality having a low Sk, a low Spk, and a low Smr2 can be obtained. Macroscopically, the resulting surface has high whiteness and high image clarity.

If the roughening is insufficient in the roughening step, the Sk and the Spk do not increase sufficiently, and, consequently, a surface having high whiteness and high image clarity cannot be obtained no matter what conditions are used for performing the flattening step. The reason for this is as follows. In instances where the roughening is insufficient, if the flattening in the flattening step is performed in a manner that sufficiently reduces the Sk and the Spk, the Smr2 excessively increases, and, consequently, the resulting surface has high image clarity but low whiteness, or, on the other hand, if the flattening is performed in a manner that does not excessively increase the Smr2, the Spk is not sufficiently reduced, and, consequently, the resulting surface has high whiteness but low image clarity.

In instances where the roughening step is performed appropriately, if the flattening in the subsequent flattening step is insufficient, the resulting surface has a high Sk and/or a high Spk with a low Smr2, that is, the resulting surface has high whiteness but low image clarity. On the other hand, if the flattening is excessive, the resulting surface has a low Sk and a low Spk with a high Smr2, that is, the resulting surface has high image clarity but low whiteness. Note that, in the roughening step, the Smr2 increases with the increase in the Sk, but, as the flattening progresses, the Smr2 decreases sharply, before a decrease in the Sk. Thereafter, as the flattening further progresses, the Smr2 again begins to increase. Immediately after the roughening, the high-Smr2 surface is a surface having high whiteness despite the high Smr2 and having low image clarity; the reason for the high whiteness is that since the Sk and Spk are high, almost the entire surface is a surface that diffusely reflects light strongly.

Aspects of the present invention were completed based on the above-described findings and further studies that were conducted. Specifically, primary features of the present invention are as follows.

[1] A stainless steel sheet having a surface quality in which a core height Sk is 1.50 μm or less, a reduced peak height Spk is 0.20 μm or less, and an areal material ratio Smr2 that separates a reduced dale from a core is 80% or less, where the core height Sk, the reduced peak height Spk, and the areal material ratio Smr2 are as specified in JIS B 0681-2:2018, wherein the stainless steel sheet has a whiteness of 50 or greater and an image clarity of 1% or greater.

[2] A method for manufacturing the stainless steel sheet according to [1], wherein the stainless steel sheet is an austenitic stainless steel sheet or a ferritic-austenitic duplex stainless steel sheet, the method includes:

a material steel sheet providing step including providing a cold-rolled annealed steel sheet that serves as a material;

a roughening step including polishing the cold-rolled annealed steel sheet to produce a cold-rolled, annealed, polished steel sheet; and a flattening step including subjecting the cold-rolled, annealed, polished steel sheet to skin-pass rolling to produce a cold-rolled, annealed, polished, skin-pass-finished steel sheet, wherein in the roughening step, the cold-rolled annealed steel sheet is subjected to a polishing treatment in which a surface roughness Sa of the cold-rolled annealed steel sheet is adjusted to be 0.20 μm or greater and 2.00 μm or less, and in the flattening step, the cold-rolled, annealed, polished steel sheet is subjected to skin-pass rolling that is performed at an elongation ratio of 0.10% or greater and 3.00% or less by using a skin-pass roll having a surface roughness Sa of 0.06 μm or less.

[3] A method for manufacturing the stainless steel sheet according to [1], wherein the stainless steel sheet is a ferritic stainless steel sheet or a martensitic stainless steel sheet, the method includes:

a material steel sheet providing step including providing a cold-rolled steel sheet that serves as a material;

a roughening step including heat-treating the cold-rolled steel sheet to form a cold-rolled annealed steel sheet and then pickling the cold-rolled annealed steel sheet to produce a cold-rolled, annealed, pickled steel sheet; and a flattening step including subjecting the cold-rolled, annealed, pickled steel sheet to skin-pass rolling to produce a cold-rolled, annealed, pickled, skin-pass-finished steel sheet, wherein in the roughening step, the cold-rolled steel sheet is subjected to a heat treatment in which the cold-rolled steel sheet is held in a temperature range of 750° C. or greater and 850° C. or less for 3 hours or more and 10 hours or less, to form the cold-rolled annealed steel sheet, and subsequently, the cold-rolled annealed steel sheet is subjected to pickling in which the cold-rolled annealed steel sheet is immersed in an aqueous solution of sulfuric acid having a concentration of 15 mass % or greater and 30 mass % or less and having a temperature of 75° C. or greater and 95° C. or less, for 30 seconds or more and 240 seconds or less and in the flattening step, the cold-rolled, annealed, pickled steel sheet is subjected to skin-pass rolling that is performed at an elongation ratio of 0.10% or greater and 3.00% or less by using a skin-pass roll having a surface roughness Sa of 0.06 μm or less.

Aspects of the present invention can provide a stainless steel sheet having high whiteness and high image clarity.

DETAILED DESCRIPTION OF EMBODIMENTS OF THE INVENTION

Aspects of the present invention will be described based on the following embodiments. A steel sheet according to aspects of the present invention has a surface having surface quality parameters adjusted as described below from the standpoint of achieving desired whiteness and image clarity.

Core Height Sk: 1.50 μm or Less

Achieving a desired image clarity requires that a core height Sk be less than or equal to 1.50 μm. If the Sk is greater than 1.50 μm, the steel sheet has low image clarity. Preferably, the Sk is less than or equal to 1.00 μm. The lower limit of the Sk is not particularly limited. From the standpoint of ensuring that the Smr2, which will be described below, can be easily made to be within a predetermined range, it is preferable that the Sk be greater than or equal to 0.30 μm.

Reduced Peak Height Spk: 0.20 μm or Less

Achieving a desired image clarity requires that a reduced peak height Spk be less than or equal to 0.20 μm. If the Spk is greater than 0.20 μm, the steel sheet has low image clarity. Preferably, the Spk is less than or equal to 0.10 μm. The lower limit of the Spk is not particularly limited. From the standpoint of ensuring that the Smr2, which will be described below, can be easily made to be within a predetermined range, it is preferable that the Spk be greater than or equal to 0.01 μm. More preferably, the Spk is greater than or equal to 0.05 μm.

Areal Material Ratio Smr2 that Separates a Reduced Dale from a Core: 80% or Less Achieving a desired whiteness requires that an areal material ratio Smr2 that separates a reduced dale from a core be less than or equal to 80%. If the Smr2 is greater than 80%, the steel sheet has low whiteness. Preferably, the Smr2 is less than or equal to 60%. The lower limit of the Smr2 is not particularly limited. From the standpoint of ensuring that the Sk and the Spk, which are described above, can be easily made to be within a predetermined range, it is preferable that the Smr2 be greater than or equal to 50%.

The surface quality parameters, which are the Sk and the others, are determined as follows.

First, profilometry is performed on a surface of the steel sheet that serves as a test sample, over a region of 94.0 μm in width and 70.5 μm in length, with a confocal laser microscope, under conditions including 2048×1536 pixels. The obtained topographical data is subjected to noise removal and subsequently to tilt correction, in which the entire measured surface is approximated as a flat surface, and the differences are taken. Note that the height of the pixels that have been removed as noise may be compensated for based on the height of the surrounding pixels.

From the obtained corrected topographical data, the surface quality parameters (Sk, Spk, Smr2, and Sa, which will be described later) of the region (fields of view) are determined in accordance with JIS B 0681-2:2018, without using an S filter (low-pass filter) or an L filter (high-pass filter) and without performing additional topography correction.

The measurement described above is performed over randomly selected 10 fields of view per steel sheet. Then, for each of the surface quality parameters (Sk, Spk, Smr2, and Sa), an arithmetic mean of the values of the fields of view is calculated, and these arithmetic means are designated as the surface quality parameters (Sk, Spk, Smr2, and Sa) of the steel sheet.

The stainless steel sheet according to aspects of the present invention has a high whiteness of 50 or greater and a high image clarity of 1% or greater as measured by the above-described methods for measuring whiteness and image clarity. Preferably, the whiteness is greater than or equal to 60. Preferably, the image clarity is greater than or equal to 10%. It is more preferable that the whiteness of greater than or equal to 60 and the image clarity of greater than or equal to 10% be both achieved. The upper limit of the whiteness is not particularly limited. Preferably, the whiteness is less than or equal to 70. The upper limit of the image clarity is not particularly limited. Preferably, the image clarity is less than or equal to 60%.

In accordance with aspects of the present invention, a thickness of the stainless steel sheet is not particularly limited. It is preferable, from the standpoint of manufacturability, that the thickness be greater than or equal to 0.1 mm. Furthermore, it is preferable that the thickness of the steel sheet be less than or equal to 4.0 mm. The thickness of the steel sheet is more preferably greater than or equal to 0.5 mm and even more preferably greater than or equal to 1.0 mm. Furthermore, the thickness of the steel sheet is more preferably less than or equal to 3.0 mm and even more preferably less than or equal to 2.0 mm.

Furthermore, the present inventors conducted studies regarding methods for manufacturing a stainless steel sheet that includes the roughening step and flattening step described above. As a result, the present inventors discovered that preferred manufacturing methods depend on the components of the steel, as will be described later.

Specifically, the present inventors discovered that a manufacturing method preferred in an instance in which the stainless steel sheet is an austenitic stainless steel sheet or a ferritic-austenitic duplex stainless steel sheet is different from a manufacturing method preferred in an instance in which the stainless steel sheet is a ferritic stainless steel sheet or a martensitic stainless steel sheet. The instance of an austenitic stainless steel sheet or a ferritic-austenitic duplex stainless steel sheet and the instance of a ferritic stainless steel sheet or a martensitic stainless steel sheet will each be described in detail below.

<Austenitic Stainless Steel Sheet and Ferritic-Austenitic Duplex Stainless Steel Sheet>

[Chemical Composition of Austenitic Stainless Steel Sheet or Ferritic-Austenitic Duplex Stainless Steel Sheet]

The instance in which the stainless steel sheet according to aspects of the present invention is an austenitic stainless steel sheet or a ferritic-austenitic duplex stainless steel sheet will be described. In this instance, a preferred chemical composition is a chemical composition containing, in mass %, C: 0.001 to 0.150%, Si: 0.01 to 2.00%, Mn: 0.01 to 6.00%, P: 0.05% or less, S: 0.040% or less, Ni: 1.5 to 22.0%, Cr: 16.0 to 24.0%, Al: 0.001 to 0.300%, and N: 0.001 to 0.250%, with the balance being Fe and incidental impurities.

In addition, the chemical composition may further contain one or more groups selected from (Group A) to (Group C), shown below.

(Group A) one or more selected from Cu: 2.00% or less, Co: 2.00% or less, Mo: 3.00% or less, and W: 2.00% or less (Group B) one or more selected from Ti: 0.50% or less, Nb: 1.00% or less, V: 0.50% or less, and Zr: 0.50% or less (Group C) one or more selected from B: 0.0050% or less, Mg: 0.0050% or less, Ca: 0.0030% or less, Y: 0.20% or less, REMs (one or more rare earth metals): 0.20% or less, Sn: 0.50% or less, and Sb: 0.50% or less Reasons will be described below. Note that "%" used in the context of chemical compositions means "mass %" unless otherwise specified.

C: 0.001 to 0.150%

C has an effect of increasing the strength of the steel sheet by being dissolved in the steel and, consequently, inhibiting scratches from being formed during manufacture, thereby increasing the manufacturability of the steel sheet. If a C content is less than 0.001%, the effect cannot be sufficiently produced. However, if the C content is greater than 0.150%, the steel becomes excessively hard, which adversely reduces the manufacturability of the steel sheet.

Accordingly, it is preferable that the C content be within a range of 0.001 to 0.150%. The C content is more preferably greater than or equal to 0.010% and even more preferably greater than or equal to 0.030%. Furthermore, the C content is more preferably less than or equal to 0.120% and even more preferably less than or equal to 0.080%.

Si: 0.01 to 2.00%

Si is an element that acts as a deoxidizing agent during steelmaking and reduces inclusions in the steel that cause surface defects in the steel sheet, thereby increasing the manufacturability of the steel sheet. Furthermore, Si has an effect of increasing the strength of the steel sheet and, consequently, inhibiting scratches from being formed during manufacture, thereby increasing the manufacturability of the steel sheet. It is preferable that a Si content be greater than or equal to 0.01% so as to produce these effects. However, if the Si content is greater than 2.00%, defects due to inclusions tend to be formed on a surface of the steel, which adversely reduces the manufacturability of the steel sheet. Accordingly, it is preferable that the Si content be within a range of 0.01 to 2.00%. The Si content is more preferably greater than or equal to 0.10% and even more preferably greater than or equal to 0.20%. Furthermore, the Si content is more preferably less than or equal to 1.00% and even more preferably less than or equal to 0.70%.

Mn: 0.01 to 6.00%

Mn has an effect of increasing the strength of the steel sheet and, consequently, inhibiting scratches from being formed during manufacture, thereby increasing the manufacturability of the steel sheet. It is preferable that a Mn content be greater than or equal to 0.01% so as to produce the effect. However, if the Mn content is greater than 6.00%, surface defects due to MnS tend to be formed on the steel sheet, which adversely reduces the manufacturability of the steel sheet. Accordingly, it is preferable that the Mn content be within a range of 0.01 to 6.00%. The Mn content is more preferably greater than or equal to 0.20% and even more preferably greater than or equal to 0.30%. Furthermore, the Mn content is more preferably less than or equal to 3.00%, even more preferably less than or equal to 2.00%, and still more preferably less than or equal to 0.90%.

P: 0.05% or Less

P is an element that embrittles the steel and causes a tendency for the formation of cracks in a surface of the steel, thereby reducing the manufacturability of the steel sheet. Accordingly, it is desirable that P be reduced as much as possible. Accordingly, it is preferable that a P content be less than or equal to 0.05%. The lower limit is not particularly limited; however, excessive dephosphorization results in an increase in the cost of manufacture. Accordingly, it is preferable that the P content be greater than or equal to 0.001%.

S: 0.040% or Less

S is an element that is present in steel as a sulfide-based inclusion, such as MnS, and causes a tendency for the formation of surface defects due to the inclusion, thereby reducing the manufacturability of the steel sheet. Accordingly, it is desirable that S be reduced as much as possible. In particular, if a S content is greater than 0.040%, the above-described influence increases. Accordingly, it is preferable that the S content be less than or equal to 0.040%. The S content is more preferably less than or equal to 0.020% and even more preferably less than or equal to 0.015%. The lower limit is not particularly limited; however, excessive desulfurization results in an increase in the cost of manufacture. Accordingly, it is preferable that the S content be greater than or equal to 0.0001%.

Ni: 1.5 to 22.0%

Ni is an element that contributes to improving the corrosion resistance of the steel sheet, thereby preventing corrosion-induced degradation in the aesthetic properties of the steel sheet. It is preferable that a Ni content be greater than or equal to 1.5% so as to produce the effect. However, if the Ni content is greater than 22.0%, the refining process is complicated, which reduces the manufacturability of the steel. Accordingly, it is preferable that the Ni content be within a range of 1.5 to 22.0%. The Ni content is more preferably greater than or equal to 2.0% and even more preferably greater than or equal to 8.0%. Furthermore, the Ni content is more preferably less than or equal to 15.0% and even more preferably less than or equal to 10.5%.

Cr: 16.0 to 24.0%

Cr is an element that contributes to improving the corrosion resistance of the steel sheet, thereby preventing corrosion-induced degradation in the aesthetic properties of the steel sheet. However, if a Cr content is greater than 24.0%, surface deterioration tends to occur during hot rolling, which reduces the manufacturability of the steel sheet. Accordingly, it is preferable that the Cr content be within a range of 16.0 to 24.0%. The Cr content is more preferably less than or equal to 22.0%, even more preferably less than or equal to 20.0%, and still more preferably less than or equal to 18.0%.

Al: 0.001 to 0.300%

Similar to Si, Al is an element that acts as a deoxidizing agent and reduces inclusions in the steel that cause surface defects in the steel sheet, thereby increasing the manufacturability of the steel sheet. It is preferable that an Al content be greater than or equal to 0.001% so as to produce the effect. However, if the Al content is greater than 0.300%, defects due to inclusions tend to be formed on a surface of the steel, which reduces the manufacturability of the steel sheet. Accordingly, it is preferable that the Al content be less than or equal to 0.300%. The Al content is more preferably less than or equal to 0.100%, even more preferably less than or equal to 0.050%, and still more preferably less than or equal to 0.010%.

N: 0.001 to 0.250%

Similar to C, N has an effect of increasing the strength of the steel sheet by being dissolved in the steel and, consequently, inhibiting scratches from being formed during manufacture, thereby increasing the manufacturability of the steel sheet. If a N content is less than 0.001%, the effect cannot be sufficiently produced. However, if the N content is greater than 0.250%, the steel becomes excessively hard, which adversely reduces the manufacturability of the steel sheet. Accordingly, it is preferable that the N content be within a range of 0.001 to 0.250%. The N content is more preferably greater than or equal to 0.005% and even more preferably greater than or equal to 0.010%. Furthermore, the N content is more preferably less than or equal to 0.200%, even more preferably less than or equal to 0.080%, and still more preferably less than or equal to 0.050%.

The above components are preferred basic components. In accordance with aspects of the present invention, the components described below may further be included.

Cu: 2.00% or Less

Cu has an effect of increasing the strength of the steel sheet. This effect can be produced when a Cu content is, preferably, greater than or equal to 0.01%. Accordingly, in instances where Cu is included, it is preferable that the Cu content be greater than or equal to 0.01%. The Cu content is more preferably greater than or equal to 0.05% and even more preferably greater than or equal to 0.10%. However, if the Cu content is greater than 2.00%, a large amount of an s-Cu phase becomes present in the steel and acts as a corrosion initiation site, and, consequently, the corrosion resistance of the steel sheet is reduced. Accordingly, in instances where Cu is included, it is preferable that the Cu content be less than or equal to 2.00%. The Cu content is more preferably less than or equal to 0.50% and even more preferably less than or equal to 0.20%.

Co: 2.00% or Less

Co has an effect of increasing the strength of the steel sheet. This effect can be produced when a Co content is, preferably, greater than or equal to 0.01%. Accordingly, in instances where Co is included, it is preferable that the Co content be greater than or equal to 0.01%. The Co content is more preferably greater than or equal to 0.05% and even more preferably greater than or equal to 0.10%. However, if the Co content is greater than 2.00%, the steel sheet is embrittled. Accordingly, in instances where Co is included, it is preferable that the Co content be less than or equal to 2.00%. The Co content is more preferably less than or equal to 0.50% and even more preferably less than or equal to 0.20%.

Mo: 3.00% or Less

Mo is an element that improves the corrosion resistance of the steel sheet. This effect can be produced when a Mo content is, preferably, greater than or equal to 0.01%. Accordingly, in instances where Mo is included, it is preferable that the Mo content be greater than or equal to 0.01%. The Mo content is more preferably greater than or equal to 0.05%, more preferably greater than or equal to 0.10%, and still more preferably greater than or equal to 0.15%. However, if the Mo content is greater than 3.00%, the steel sheet is embrittled. Accordingly, in instances where Mo is included, it is preferable that the Mo content be less than or equal to 3.00%. The Mo content is more preferably less than or equal to 0.80%, even more preferably less than or equal to 0.60%, and still more preferably less than or equal to 0.45%.

W: 2.00% or Less

W is an element that improves the corrosion resistance of the steel sheet. This effect can be produced when a W content is, preferably, greater than or equal to 0.01%. Accordingly, in instances where W is included, it is preferable that the W content be greater than or equal to 0.01%. The W content is more preferably greater than or equal to 0.05% and even more preferably greater than or equal to 0.10%. However, if the W content is greater than 2.00%, the steel sheet is embrittled. Accordingly, in instances where W is included, it is preferable that the W content be less than or equal to 2.00%. The W content is more preferably less than or equal to 0.50% and even more preferably less than or equal to 0.20%.

Ti: 0.50% or Less

Ti is an element that improves the corrosion resistance of the steel sheet. This effect can be produced when a Ti content is, preferably, greater than or equal to 0.01%. Accordingly, in instances where Ti is included, it is preferable that the Ti content be greater than or equal to 0.01%. The Ti content is more preferably greater than or equal to 0.02% and even more preferably greater than or equal to 0.03%. However, if the Ti content is greater than 0.50%, the steel sheet is embrittled. Accordingly, in instances where Ti is included, it is preferable that the Ti content be less than or equal to 0.50%. The Ti content is more preferably less than or equal to 0.30% and even more preferably less than or equal to 0.10%.

Nb: 1.00% or Less

Similar to Ti, Nb has an effect of improving the corrosion resistance of the steel sheet. This effect can be produced when a Nb content is, preferably, greater than or equal to 0.01%. Accordingly, in instances where Nb is included, it is preferable that the Nb content be greater than or equal to 0.01%. The Nb content is more preferably greater than or equal to 0.02% and even more preferably greater than or equal to 0.03%. However, if the Nb content is greater than 1.00%, the steel sheet is embrittled. Accordingly, in instances where Nb is included, it is preferable that the Nb content be less than or equal to 1.00%. The Nb content is more preferably less than or equal to 0.50% and even more preferably less than or equal to 0.20%.

V: 0.50% or Less

Similar to Ti and Nb, V has an effect of improving the corrosion resistance of the steel sheet. This effect can be produced when a V content is, preferably, greater than or equal to 0.01%. Accordingly, in instances where V is included, it is preferable that the V content be greater than or equal to 0.01%. The V content is more preferably greater than or equal to 0.02% and even more preferably greater than or equal to 0.03%. However, if the V content is greater than 0.50%, the steel sheet is embrittled. Accordingly, in instances where V is included, it is preferable that the V content be less than or equal to 0.50%. The V content is more preferably less than or equal to 0.20% and even more preferably less than or equal to 0.10%.

Zr: 0.50% or Less

Similar to Ti and Nb, Zr has an effect of improving the corrosion resistance of the steel sheet. This effect can be produced when a Zr content is, preferably, greater than or equal to 0.01%. Accordingly, in instances where Zr is included, it is preferable that the Zr content be greater than or equal to 0.01%. The Zr content is more preferably greater than or equal to 0.02% and even more preferably greater than or equal to 0.03%. However, if the Zr content is greater than 0.50%, the steel sheet is embrittled. Accordingly, in instances where Zr is included, it is preferable that the Zr content be less than or equal to 0.50%. The Zr content is more preferably less than or equal to 0.20% and even more preferably less than or equal to 0.10%.

B: 0.0050% or Less

B is an element that prevents edge cracking from occurring in the steel sheet during hot rolling, thereby improving the manufacturability of the steel sheet. This effect can be produced when a B content is, preferably, greater than or equal to 0.0002%. Accordingly, in instances where B is included, it is preferable that the B content be greater than or equal to 0.0002%. The B content is more preferably greater than or equal to 0.0003% and even more preferably greater than or equal to 0.0005%. However, if the B content is greater than 0.0050%, hot workability is reduced, which reduces the manufacturability of the steel sheet. Accordingly, in instances where B is included, it is preferable that the B content be less than or equal to 0.0050%. The B content is more preferably less than or equal to 0.0030% and even more preferably less than or equal to 0.0020%.

Mg: 0.0050% or Less

Mg forms a Mg oxide with Al in molten steel and acts as a deoxidizing agent. This effect can be produced when a Mg content is, preferably, greater than or equal to 0.0005%. Accordingly, in instances where Mg is included, it is preferable that the Mg content be greater than or equal to 0.0005%. The Mg content is more preferably greater than or equal to 0.0010%. On the other hand, if the Mg content is greater than 0.0050%, the steel sheet is embrittled. Accordingly, in instances where Mg is included, it is preferable that the Mg content be less than or equal to 0.0050%. The Mg content is more preferably less than or equal to 0.0030%.

Ca: 0.0030% or Less

Ca forms an oxide in molten steel and acts as a deoxidizing agent. This effect can be produced when a Ca content is, preferably, greater than or equal to 0.0003%. Accordingly, in instances where Ca is included, it is preferable that the Ca content be greater than or equal to 0.0003%. The Ca content is more preferably greater than or equal to 0.0005% and even more preferably greater than or equal to 0.0007%. However, if the Ca content is greater than 0.0030%, a large amount of CaS is formed in the steel and acts as a corrosion initiation site, and, consequently, the corrosion resistance of the steel sheet is reduced. Accordingly, in instances where Ca is included, it is preferable that the Ca content be less than or equal to 0.0030%. The Ca content is more preferably less than or equal to 0.0025% and even more preferably less than or equal to 0.0015%.

Y: 0.20% or Less

Y is an element that prevents edge cracking from occurring in the steel sheet during hot rolling, thereby improving the manufacturability of the steel sheet. This effect can be produced when a Y content is, preferably, greater than or equal to 0.01%. Accordingly, in instances where Y is included, it is preferable that the Y content be greater than or equal to 0.01%. The Y content is more preferably greater than or equal to 0.02%. However, if the Y content is greater than 0.20%, hot workability is reduced, which reduces the manufacturability of the steel sheet. Accordingly, in instances where Y is included, it is preferable that the Y content be less than or equal to 0.20%. The Y content is more preferably less than or equal to 0.05%.

REMs: 0.20% or Less

REMs (rare earth metals) are elements that prevent edge cracking from occurring in the steel sheet during hot rolling, thereby improving the manufacturability of the steel sheet. This effect can be produced when an REM content is, preferably, greater than or equal to 0.01%. Accordingly, in instances where one or more REMs are included, it is preferable that the REM content be greater than or equal to 0.01%. The REM content is more preferably greater than or equal to 0.02%. However, if the REM content is greater than 0.20%, hot workability is reduced, which reduces the manufacturability of the steel sheet. Accordingly, in instances where one or more REMs are included, it is preferable that the REM content be less than or equal to 0.20%. The REM content is more preferably less than or equal to 0.05%. Note that in this specification, the "REMs" refers to the elements (excluding Y) belonging to Group 3 of the periodic table. Furthermore, as referred to herein, the "REM content" is the total content of these elements.

Sn: 0.50% or Less

Sn is an element that prevents surface deterioration from occurring on the steel sheet during hot rolling, thereby improving the manufacturability of the steel sheet. This effect can be produced when a Sn content is, preferably, greater than or equal to 0.01%. Accordingly, in instances where Sn is included, it is preferable that the Sn content be greater than or equal to 0.01%. The Sn content is more preferably greater than or equal to 0.03%. However, if the Sn content is greater than 0.50%, the steel sheet is embrittled. Accordingly, in instances where Sn is included, it is preferable that the Sn content be less than or equal to 0.50%. The Sn content is more preferably less than or equal to 0.20%.

Sb: 0.50% or Less

Sb is an element that prevents surface deterioration from occurring on the steel sheet during hot rolling, thereby improving the manufacturability of the steel sheet. This effect can be produced when an Sb content is, preferably, greater than or equal to 0.01%. Accordingly, in instances where Sb is included, it is preferable that the Sb content be greater than or equal to 0.01%. The Sb content is more preferably greater than or equal to 0.03%. However, if the Sb content is greater than 0.50%, the steel sheet is embrittled. Accordingly, in instances where Sb is included, it is preferable that the Sb content be less than or equal to 0.50%. The Sb content is more preferably less than or equal to 0.20%.

The balance, other than the components described above, is Fe and incidental impurities.

[Method for Manufacturing Austenitic Stainless Steel Sheet or Ferritic-Austenitic Duplex Stainless Steel Sheet]

Now, a manufacturing method used in the instance in which the stainless steel sheet according to aspects of the present invention is an austenitic stainless steel sheet or a ferritic-austenitic duplex stainless steel sheet will be described. In this instance, the manufacturing method, according to an embodiment, includes a providing step of providing a steel sheet that serves as a material; a roughening step; and a flattening step.

Specifically, according to an embodiment, the method for manufacturing an austenitic stainless steel sheet or a ferritic-austenitic duplex stainless steel sheet, according to aspects of the present invention, includes a material steel sheet providing step including providing a cold-rolled annealed steel sheet having the above-described chemical composition; a roughening step including polishing the cold-rolled annealed steel sheet to produce a cold-rolled, annealed, polished steel sheet; and a flattening step including subjecting the cold-rolled, annealed, polished steel sheet to skin-pass rolling to produce a cold-rolled, annealed, polished, skin-pass-finished steel sheet. In the roughening step, the cold-rolled annealed steel sheet is subjected to a polishing treatment in which a surface roughness Sa of the cold-rolled annealed steel sheet is adjusted to be 0.20 μm or greater and 2.00 μm or less. In the flattening step, the cold-rolled, annealed, polished steel sheet is subjected to skin-pass rolling that performs rolling at an elongation ratio of 0.10% or greater and 3.00% or less by using skin-pass rolls having a surface roughness Sa of 0.06 μm or less.

(Material Steel Sheet Providing Step)

The material steel sheet providing step is a step of providing a steel sheet that serves as a material. The material steel sheet is a material steel sheet having a chemical composition such as that described above and which can be provided, for example, in the following non-limiting manner.

For example, in an embodiment, molten steel is prepared by steelmaking in a melting furnace, such as a converter, an electric furnace, or a vacuum melting furnace, to produce molten steel adjusted to have the above-described chemical composition. Subsequently, the molten steel is subjected to a continuous casting process, an ingot casting-blooming process, or the like, to form a steel material (steel slab). Subsequently, the steel material is subjected to hot rolling to form a hot-rolled steel sheet. Subsequently, the hot-rolled steel sheet is subjected to hot-rolled sheet annealing to form a hot-rolled annealed steel sheet. If necessary, the produced hot-rolled annealed steel sheet is subjected to a descaling treatment, which may be performed by salt bath immersion, pickling, shot blasting, surface grinding, or the like. Furthermore, if necessary, the hot-rolled annealed steel sheet may be subjected to skin-pass rolling.

Subsequently, the hot-rolled annealed steel sheet is subjected to cold rolling to form a cold-rolled steel sheet, and the produced cold-rolled steel sheet is subjected to cold-rolled sheet annealing to form a cold-rolled annealed steel sheet. If necessary, the produced cold-rolled annealed steel sheet is subjected to a descaling treatment, which may be performed by salt bath immersion, pickling, shot blasting, surface grinding, or the like, to form the material steel sheet.

The conditions for the hot rolling, the hot-rolled sheet annealing, the cold rolling, and the cold-rolled sheet annealing are not particularly limited, and commonly used processes can be employed. For example, the hot rolling is performed as follows. The steel material is heated to a temperature of 1150 to 1350° C., held in the temperature range for 30 minutes to 24 hours, and subsequently rolled. Alternatively, in instances where the steel material is within the temperature range described above immediately after being cast, the steel material is directly rolled without being heated. A hot rolling reduction ratio is not particularly limited and may be appropriately adjusted in accordance with, for instance, a required thickness of the final product. The hot-rolled sheet annealing is performed as follows. The hot-rolled steel sheet is heated to a temperature range of 1000 to 1300° C. and held in the temperature range for 5 seconds to 24 hours. The cold rolling is preferably performed in a cluster mill. A cold rolling reduction ratio is not particularly limited and may be greater than or equal to 40%, which is preferable from the standpoint of smoothing the surface topography of the steel sheet. The cold-rolled sheet annealing is performed as follows. The cold-rolled steel sheet is heated to a temperature range of 1000 to 1200° C. and held in the temperature range for 5 seconds to 24 hours.

(Roughening Step)

Subsequently, in the roughening step, a surface of the material steel sheet provided as described above is subjected to a polishing treatment to produce a cold-rolled, annealed, polished steel sheet. In the polishing treatment, it is important to adjust the surface roughness Sa of the steel sheet to be 0.20 to 2.00 μm. Examples of methods for the polishing treatment include methods in which a) the surface is abraded with sandpaper; b) a rotating grinding wheel is brought into contact with the steel sheet and moved thereon; c) the steel sheet is brought into contact with a rotating abrasive belt and moved thereon; or d) the steel sheet is passed through a pair of rotating brushes. With any of the methods, the surface roughness Sa can be adjusted by making a change, which may be made, for instance, to the abrasive (a hardness, a size, and the like of abrasive grains that are attached to sandpaper, a grinding wheel, an abrasive belt, or the like); a pressing force of the abrasive against the steel sheet; and/or a polishing speed (a relative speed between the steel sheet and the abrasive that is in contact with the steel sheet, the relative speed being adjustable, for example, with a rotation speed of an abrasive belt or brushes).

The surface roughness Sa is determined by the calculation method for the surface roughness parameters that uses a confocal laser microscope, as described above. The surface roughness Sa is one of the surface quality parameters specified in JIS B 0681-2:2018 and represents an arithmetic mean height. The arithmetic mean height is a mean of the absolute values of heights from a mean plane of the surface at multiple points and is a parameter commonly used for the evaluation of surface roughness. The method for measuring the surface roughness Sa is specifically described in the Examples section.

Surface Roughness Sa Resulting from Polishing: 0.20 μm or Greater and 2.00 μm or Less In the polishing treatment, an adjustment is made such that the surface roughness Sa resulting from the polishing falls within a range of 0.20 to 2.00 μm. If the surface roughness Sa resulting from the polishing is less than 0.20 μm, a surface having high whiteness and high image clarity cannot be obtained no matter what conditions are used for performing flattening in the flattening step, which will be described below. Specifically, in the flattening step described below, if the skin-pass rolling is performed under conditions with a low elongation ratio, the resulting surface has high whiteness but low image clarity. On the other hand, if the elongation ratio for the skin-pass rolling is increased, the resulting surface initially has low whiteness and low image clarity and thereafter has high image clarity but low whiteness. That is, in any case, a surface having high whiteness and high image clarity cannot be obtained. If the surface roughness Sa resulting from the polishing is greater than 2.00 μm, the skin-pass rolling in the flattening step described below needs to be performed at an excessively high elongation ratio to obtain a surface having high image clarity, and, consequently, manufacturability is degraded. Accordingly, the surface roughness Sa resulting from the polishing is specified to be 0.20 μm or greater and 2.00 μm or less.

(Flattening Step)

Subsequently, in the flattening step, the cold-rolled, annealed, polished steel sheet produced as described above is subjected to skin-pass rolling. In the skin-pass rolling, it is important to roll the cold-rolled, annealed, polished steel sheet at an elongation ratio of 0.10% or greater and 3.00% or less by using skin-pass rolls having a surface roughness Sa of 0.06 μm or less. The surface roughness Sa of the skin-pass rolls is determined by the calculation method for the surface roughness parameters that uses a confocal laser microscope, as described above, with a surface of the skin-pass rolls serving as a test sample. Furthermore, the surface roughness Sa of the skin-pass rolls is a parameter specified in JIS B 0681-2:2018, as with that of the roughening step described above. Furthermore, a roll diameter of the skin-pass rolls and a speed of the steel sheet during rolling are not particularly limited; for example, skin-pass rolls having a roll diameter of 800 to 900 mm is used, and the speed of the steel sheet is 40 to 50 mpm. Furthermore, during the skin-pass rolling, a tension may be applied to the steel sheet. The tension is not particularly limited. For example, the tension is 20 kgf/mm$^2$ or greater and 30 kgf/mm$^2$ or less.

Surface Roughness Sa of Skin-Pass Rolls: 0.06 μm or Less

If the surface roughness Sa of the skin-pass rolls is greater than 0.06 μm, the resulting roll transfer area of the surface of the steel sheet is coarse, and, consequently, the steel sheet resulting from the skin-pass rolling does not have high image clarity. Accordingly, the surface roughness Sa of the skin-pass rolls is specified to be less than or equal to 0.06 μm. It is preferable that the surface roughness Sa of the skin-pass rolls be as low as possible, and the lower limit is not particularly limited. For example, the surface roughness Sa of the skin-pass rolls may be specified to be greater than or equal to 0.01 μm, from the standpoint of costs and a polishing load.

Elongation Ratio for Skin-Pass Rolling: 0.10% or Greater and 3.00% or Less

If the elongation ratio for the skin-pass rolling is less than 0.10%, the resulting Sk and the Spk of the surface of the steel sheet are high, and, consequently, a desired image clarity cannot be achieved. On the other hand, if the elongation ratio for the skin-pass rolling is greater than 3.00%, the resulting Smr2 of the surface of the steel sheet is high, and, consequently, a desired whiteness cannot be achieved. Accordingly, the elongation ratio for the skin-pass rolling is specified to be 0.10% or greater and 3.00% or less. The skin-pass rolling may be performed in a single pass or multiple passes. In the instance where the skin-pass rolling is performed in multiple passes, the sum of the elongation ratios of the multiple passes is to be within the above-mentioned range. The elongation ratio for the skin-pass rolling (skin-pass elongation ratio) (%) is calculated according to the equation below.

$$\text{Skin-pass elongation ratio (\%)} = (\text{length of steel sheet after skin-pass rolling})/(\text{length of steel sheet before skin-pass rolling}) \times 100 - 100$$

<Ferritic Stainless Steel Sheet and Martensitic Stainless Steel Sheet>

[Chemical Composition of Ferritic Stainless Steel Sheet or Martensitic Stainless Steel Sheet]

The instance in which the stainless steel sheet according to aspects of the present invention is a ferritic stainless steel sheet or a martensitic stainless steel sheet will be described. In this instance, a preferred chemical composition is a chemical composition containing, in mass %, C: 0.001 to 0.500%, Si: 0.01 to 2.00%, Mn: 0.01 to 2.00%, P: 0.05% or less, S: 0.040% or less, Ni: 0.01% or greater and less than 1.50%, Cr: 10.5 to 30.0%, Al: 0.001 to 6.5%, and N: 0.001 to 0.250%, with the balance being Fe and incidental impurities.

In addition, the chemical composition may further contain one or more groups selected from (Group A) to (Group C), shown above.

Reasons will be described below.

C: 0.001 to 0.500%

C has an effect of increasing the strength of the steel sheet by being dissolved in the steel and, consequently, inhibiting scratches from being formed during manufacture, thereby increasing the manufacturability of the steel sheet. If a C content is less than 0.001%, the effect cannot be sufficiently produced. However, if the C content is greater than 0.500%, defects due to a carbide tend to be formed on a surface of the steel, which adversely reduces the manufacturability of the steel sheet. Accordingly, it is preferable that the C content be within a range of 0.001 to 0.500%. In the instance of ferritic stainless steel sheets, the C content is more preferably greater than or equal to 0.010% and even more preferably greater than or equal to 0.030%. Furthermore, in the instance of ferritic stainless steel sheets, the C content is more preferably less than or equal to 0.150% and even more preferably less than or equal to 0.050%. In the instance of martensitic stainless steel sheets, the C content is more preferably greater than or equal to 0.050%. Furthermore, in the instance of martensitic stainless steel sheets, the C content is more preferably less than or equal to 0.40%.

Si: 0.01 to 2.00%

Si is an element that acts as a deoxidizing agent during steelmaking and reduces inclusions in the steel that cause surface defects in the steel sheet, thereby increasing the manufacturability of the steel sheet. Furthermore, Si has an effect of increasing the strength of the steel sheet and, consequently, inhibiting scratches from being formed during manufacture, thereby increasing the manufacturability of the steel sheet. It is preferable that a Si content be greater than or equal to 0.01% so as to produce these effects. However, if the Si content is greater than 2.00%, defects due to inclusions tend to be formed on a surface of the steel, which adversely reduces the manufacturability of the steel sheet. Accordingly, it is preferable that the Si content be within a range of 0.01 to 2.00%. The Si content is more preferably greater than or equal to 0.10% and even more preferably greater than or equal to 0.20%. Furthermore, the Si content is more preferably less than or equal to 1.00% and even more preferably less than or equal to 0.70%.

Mn: 0.01 to 2.00%

Mn has an effect of increasing the strength of the steel sheet and, consequently, inhibiting scratches from being formed during manufacture, thereby increasing the manufacturability of the steel sheet. It is preferable that a Mn content be greater than or equal to 0.01% so as to produce the effect. However, if the Mn content is greater than 2.00%, surface defects due to MnS tend to be formed on the steel sheet, which adversely reduces the manufacturability of the steel sheet. Accordingly, it is preferable that the Mn content be within a range of 0.01 to 2.00%. The Mn content is more preferably greater than or equal to 0.20% and even more preferably greater than or equal to 0.30%. Furthermore, the Mn content is more preferably less than or equal to 1.00% and even more preferably less than or equal to 0.90%.

P: 0.05% or Less

P is an element that embrittles the steel and causes a tendency for the formation of cracks in a surface of the steel, thereby reducing the manufacturability of the steel sheet. Accordingly, it is preferable that a P content be less than or equal to 0.05%. The P content is more preferably less than or equal to 0.04%. It should be noted that in instances where P is caused to segregate at grain boundaries in the manufacturing process, P has an effect of promoting pickling-induced roughening of the steel sheet. It is preferable that the P content be greater than or equal to 0.01% so as to produce the effect. More preferably, the P content is greater than or equal to 0.02%.

S: 0.040% or Less

S is an element that is present in steel as a sulfide-based inclusion, such as MnS, and causes a tendency for the formation of surface defects due to the inclusion, thereby reducing the manufacturability of the steel sheet. Accordingly, it is desirable that S be reduced as much as possible. In particular, if a S content is greater than 0.040%, the above-described influence increases. Accordingly, it is preferable that the S content be less than or equal to 0.040%. The S content is more preferably less than or equal to 0.020% and even more preferably less than or equal to 0.015%. The lower limit is not particularly limited; however, excessive desulfurization results in an increase in the cost of manufacture. Accordingly, it is preferable that the S content be greater than or equal to 0.0001%.

Ni: 0.01% or Greater and Less than 1.50%

Ni is an element that contributes to improving the toughness of the steel sheet and inhibits a fracture of the steel sheet from occurring in the manufacturing process, thereby improving the manufacturability of the steel sheet. It is preferable that a Ni content be greater than or equal to 0.01% so as to produce the effect. However, if the Ni content is greater than or equal to 1.50%, a descaling process becomes difficult in the manufacturing process, which reduces the manufacturability of the steel. Accordingly, it is preferable that the Ni content be within a range of 0.01% or greater and less than 1.50%. The Ni content is more preferably greater than or equal to 0.05%. Furthermore, the Ni content is more preferably less than 1.00% and even more preferably less than 0.30%.

Cr: 10.5 to 30.0%

Cr is an element that contributes to improving the corrosion resistance of the steel sheet, thereby preventing corrosion-induced degradation in the aesthetic properties of the steel sheet. However, if a Cr content is greater than 30.0%, surface deterioration tends to occur during hot rolling, which reduces the manufacturability of the steel sheet. Accordingly, it is preferable that the Cr content be within a range of 10.5 to 30.0%. In the instance of ferritic stainless steel sheets, the Cr content is more preferably greater than or equal to 12.0% and even more preferably greater than or equal to 16.0%. Furthermore, in the instance of ferritic stainless steel sheets, the Cr content is more preferably less than or equal to 22.0% and even more preferably less than or equal to 18.0%. In the instance of martensitic stainless steel sheets, the Cr content is more preferably less than or equal to 17.0% and even more preferably less than or equal to 14.0%.

Al: 0.001 to 6.5%

Similar to Si, Al is an element that acts as a deoxidizing agent and reduces inclusions in the steel that cause surface defects in the steel sheet, thereby increasing the manufacturability of the steel sheet. It is preferable that an Al content be greater than or equal to 0.001% so as to produce the effect. However, if the Al content is greater than 6.5%, the steel is embrittled, and, therefore, cracks tend to be formed in a surface, which reduces the manufacturability of the steel sheet. Accordingly, it is preferable that the Al content be within a range of 0.001 to 6.5%. The Al content is more preferably less than or equal to 0.600% and even more preferably less than or equal to 0.060%.

N: 0.001 to 0.250%

Similar to C, N has an effect of increasing the strength of the steel sheet by being dissolved in the steel and, consequently, inhibiting scratches from being formed during manufacture, thereby increasing the manufacturability of the steel sheet. If a N content is less than 0.001%, the effect cannot be sufficiently produced. However, if the N content is greater than 0.250%, the steel becomes excessively hard, which adversely reduces the manufacturability of the steel sheet. Accordingly, it is preferable that the N content be within a range of 0.001 to 0.250%. The N content is more preferably greater than or equal to 0.005% and even more preferably greater than or equal to 0.010%. Furthermore, the N content is more preferably less than or equal to 0.080% and even more preferably less than or equal to 0.050%.

The above components are preferred basic components. In addition, in accordance with aspects of the present invention, one or more groups selected from (Group A) to (Group C), shown above, may be included. Regarding the instance in which one or more groups selected from (Group A) to (Group C), shown above, are included, a preferred content range of each of the elements and the reason therefor are the same as those described above and are, therefore, not described here.

The balance, other than the components described above, is Fe and incidental impurities.

[Method for Manufacturing Ferritic Stainless Steel Sheet or Martensitic Stainless Steel Sheet]

Now, a manufacturing method used in the instance in which the stainless steel sheet according to aspects of the present invention is a ferritic stainless steel sheet or a martensitic stainless steel sheet will be described. In this instance, the manufacturing method, according to an embodiment, includes a providing step of providing a steel sheet that serves as a material steel sheet; a roughening step; and a flattening step.

Specifically, according to an embodiment, the method for manufacturing a ferritic stainless steel sheet or a martensitic stainless steel sheet, according to aspects of the present invention, includes a material steel sheet providing step including providing a cold-rolled steel sheet having the above-described chemical composition; a roughening step including heat-treating the cold-rolled steel sheet to form a cold-rolled annealed steel sheet and then pickling the cold-rolled annealed steel sheet to produce a cold-rolled, annealed, pickled steel sheet; and a flattening step including subjecting the cold-rolled, annealed, pickled steel sheet to skin-pass rolling to produce a cold-rolled, annealed, pickled, skin-pass-finished steel sheet. In the roughening step, the cold-rolled steel sheet is subjected to a heat treatment in which the cold-rolled steel sheet is held in a temperature range of 750° C. or greater and 850° C. or less for 3 hours or more and 10 hours or less, to form a cold-rolled annealed steel sheet, and subsequently, the cold-rolled annealed steel sheet is subjected to pickling in which the cold-rolled annealed steel sheet is immersed in an aqueous solution of sulfuric acid having a concentration of 15 mass % or greater and 30 mass % or less and having a temperature of 75° C. or greater and 95° C. or less, for 30 seconds or more and 240 seconds or less, to produce a cold-rolled, annealed, pickled steel sheet. In the flattening step, the cold-rolled, annealed, pickled steel sheet is subjected to skin-pass rolling that is performed at an elongation ratio of 0.10% or greater and 3.00% or less by using skin-pass rolls having a surface roughness Sa of 0.06 μm or less.

In the cases of ferritic stainless steels and martensitic stainless steels, the roughening of a surface can be easily accomplished by pickling, compared with austenitic stainless steels and ferritic-austenitic duplex stainless steels. Accordingly, aspects of the present invention can be embodied without adding one or more processes, such as polishing, to the common manufacturing processes including cold-rolled sheet annealing, pickling of a cold-rolled annealed steel sheet, and skin-pass rolling, provided that each of the common manufacturing processes is carried out under appropriate conditions.

Furthermore, in the roughening step, it is preferable to utilize P, in particular. That is, in the cases of ferritic stainless steels and martensitic stainless steels, P in the steel can be caused to segregate at or near the grain boundaries in the steel microstructures of the cold-rolled annealed steel sheet, by carrying out the heat treatment (annealing) of the cold-rolled steel sheet under appropriate conditions. Furthermore, in instances where the cold-rolled annealed steel sheet in which P has segregated at grain boundaries is pickled under appropriate conditions, regions at or near the grain boundaries, among others, of the surface of the steel sheet can be preferentially dissolved into the pickling solution. Accordingly, the roughening of the surface of the steel sheet can be particularly easily accomplished.

(Material Steel Sheet Providing Step)

The material steel sheet providing step is a step of providing a steel sheet that serves as a material. The material steel sheet is a material steel sheet having a chemical composition such as that described above and which can be provided, for example, in the following non-limiting manner.

For example, in an embodiment, molten steel is prepared by steelmaking in a melting furnace, such as a converter, an electric furnace, or a vacuum melting furnace, to produce molten steel adjusted to have the above-described chemical composition. Subsequently, the molten steel is subjected to a continuous casting process, an ingot casting-blooming process, or the like, to form a steel material (steel slab). Subsequently, the steel material is subjected to hot rolling to form a hot-rolled steel sheet. Subsequently, the hot-rolled steel sheet is subjected to hot-rolled sheet annealing to form a hot-rolled annealed steel sheet. If necessary, the produced hot-rolled annealed steel sheet is subjected to a descaling treatment, which may be performed by pickling, shot blasting, surface grinding, or the like. Furthermore, if necessary, the hot-rolled annealed steel sheet may be subjected to skin-pass rolling.

Subsequently, the hot-rolled annealed steel sheet is subjected to cold rolling to form a cold-rolled steel sheet, which serves as the material steel sheet.

The conditions for the hot rolling, the hot-rolled sheet annealing, and the cold rolling are not particularly limited, and commonly used processes can be employed. For example, the hot rolling is performed as follows. The steel material is heated to a temperature of 1050 to 1250° C., held in the temperature range for 30 minutes to 24 hours, and subsequently rolled. Alternatively, in instances where the steel material is within the temperature range described above immediately after being cast, the steel material is directly rolled without being heated. A hot rolling reduction ratio is not particularly limited and may be appropriately adjusted in accordance with, for instance, a required thickness of the final product. The hot-rolled sheet annealing is performed as follows. The hot-rolled steel sheet is heated to a temperature range of 750 to 850° C. and held in the temperature range for 1 hour to 24 hours, or the hot-rolled steel sheet is heated to a temperature range of 900 to 1100° C. and held in the temperature range for 10 seconds to 5 minutes. The cold rolling is preferably performed in a cluster mill. A cold rolling reduction ratio is not particularly limited and may be greater than or equal to 40%, which is preferable from the standpoint of smoothing the surface topography of the steel sheet.

(Roughening Step)

Subsequently, in the roughening step, the material steel sheet provided as described above is subjected to a heat treatment (annealing) and subsequently to pickling, to produce a cold-rolled, annealed, pickled steel sheet. In the heat treatment, it is important to heat the material steel sheet to a temperature range of 750° C. or greater and 850° C. or less and hold the material steel sheet in the temperature range for 3 hours or more and 10 hours or less. Furthermore, in the subsequent pickling, it is important to immerse the produced cold-rolled annealed steel sheet in an aqueous solution of sulfuric acid for 30 seconds or more and 240 seconds or less, the aqueous solution of sulfuric acid having a concentration of 15 mass % or greater and 30 mass % or less and being maintained in a temperature range of 75° C. or greater and 95° C. or less.

Holding Temperature for Heat Treatment (Annealing): 750° C. or Greater and 850° C. or Less In the roughening step, first, the cold-rolled steel sheet is subjected to a heat treatment (annealing) to cause P to segregate at the grain boundaries in the steel microstructures. If a holding temperature for the heat treatment is less than 750° C., crystals do not sufficiently grow, which results in an insufficient formation of the grain boundaries that serve as the segregation sites for P. On the other hand, if the holding temperature for the heat treatment is greater than 850° C., P tends to diffuse in the steel, which leads to the diffusion of P into the grains, and, consequently, P does not segregate at grain boundaries. Accordingly, the holding temperature for the heat treatment is specified to be 750° C. or greater and 850° C. or less. The holding temperature for the heat treatment is preferably greater than or equal to 810° C. Furthermore, the holding temperature for the heat treatment is preferably less than or equal to 840° C. The holding temperature for the heat treatment may be constant during the holding or need not be consistently constant during the holding provided that the temperatures are within the mentioned temperature range.

Holding Time for Heat Treatment (Annealing): 3 Hours or More and 10 Hours or Less If a holding time for the heat treatment is less than 3 hours, P does not sufficiently segregate at grain boundaries. On the other hand, if the holding time for the heat treatment is more than 10 hours, a coarse carbonitride that causes surface defects during the subsequent pickling is formed in the steel, which reduces manufacturability. Accordingly, the holding time for the heat treatment is specified to be 3 hours or more and 10 hours or less (180 minutes or more and 600 minutes or less). The holding time for the heat treatment is preferably more than or equal to 6 hours. Furthermore, the holding time for the heat treatment is preferably less than or equal to 8 hours. After the holding in the holding temperature range for the heat treatment is carried out, cooling is carried out, for which natural furnace cooling may be used, or holding at a temperature in a temperature range lower than the mentioned temperature range may be used.

Subsequently, the cold-rolled annealed steel sheet is subjected to pickling to produce a cold-rolled, annealed, pickled steel sheet. In the pickling, it is important to immerse the cold-rolled annealed steel sheet in a 15 to 30 mass % aqueous solution of sulfuric acid for 30 seconds or more and 240 seconds or less, with the aqueous solution of sulfuric acid being maintained in a temperature range of 75° C. or greater and 95° C. or less. Before and/or after the pickling, one or more other types of pickling may be performed under conditions in which a pickling weight loss is not greater than 5 g/m$^2$. For example, after the immersion in the aqueous solution of sulfuric acid, immersion in a mixed aqueous solution of nitric acid and hydrofluoric acid may be performed to remove smut. Furthermore, after the immersion in the aqueous solution of sulfuric acid, immersion in an aqueous solution of nitric acid and electrolysis of the steel in the aqueous solution of nitric acid may be performed to accomplish passivation.

Temperature of Aqueous Solution of Sulfuric Acid: 75° C. or Greater and 95° C. or Less If the temperature of the aqueous solution of sulfuric acid is less than 75° C., the roughening caused by pickling cannot be sufficiently accomplished, and as a result, a surface having high whiteness and high image clarity cannot be obtained no matter what conditions are used for performing flattening in the flattening step, which will be described below. On the other hand, if the temperature of the aqueous solution of sulfuric acid is greater than 95° C., the skin-pass rolling in the flattening step described below needs to be performed at an excessively high elongation ratio to obtain a surface having high image clarity, and, consequently, manufacturability is degraded. Accordingly, the temperature of the aqueous solution of sulfuric acid for performing the pickling is specified to be 75° C. or greater and 95° C. or less.

Concentration of Aqueous Solution of Sulfuric Acid: 15 Mass % or Greater and 30 Mass % or Less If the concentration of the aqueous solution of sulfuric acid is less than 15 mass %, the roughening caused by pickling cannot be sufficiently accomplished, and as a result, a surface having high whiteness and high image clarity cannot be obtained no matter what conditions are used for performing flattening in the flattening step described below. Furthermore, if the concentration of the aqueous solution of sulfuric acid is greater than 30 mass %, the dissolution of steel into the pickling solution is adversely inhibited, and, consequently, roughening caused by pickling cannot be sufficiently accomplished; as a result, a surface having high whiteness and high image clarity cannot be obtained no matter what conditions are used for performing flattening in the flattening step described below. Accordingly, the concentration of the aqueous solution of sulfuric acid for performing the pickling is specified to be 15 mass % or greater and 30 mass % or less. The aqueous solution of sulfuric acid may contain impurities that are inevitably present in pickling solutions, such as Fe ions and Cr ions.

Time of Immersion in Aqueous Solution of Sulfuric Acid: 30 Seconds or More and 240 Seconds or Less If a time of immersion in the aqueous solution of sulfuric acid is less than 30 seconds, the roughening caused by pickling cannot be sufficiently accomplished, and as a result, a surface having high whiteness and high image clarity cannot be obtained no matter what conditions are used for performing flattening in the flattening step described below. On the other hand, if the time of immersion in the aqueous solution of sulfuric acid is greater than 240 seconds, the skin-pass rolling in the flattening step described below needs to be performed at an excessively high elongation ratio to obtain a surface having high image clarity, and, consequently, manufacturability is degraded. Accordingly, the time of immersion in the aqueous solution of sulfuric acid for performing the pickling is specified to be 30 seconds or more and 240 seconds or less.

(Flattening Step)

Subsequently, in the flattening step, the cold-rolled, annealed, pickled steel sheet produced as described above is subjected to skin-pass rolling. In the skin-pass rolling, it is important to roll the cold-rolled, annealed, pickled steel sheet at an elongation ratio of 0.10% or greater and 3.00% or less by using skin-pass rolls having a surface roughness Sa of 0.06 μm or less. The surface roughness Sa of the skin-pass rolls is determined by the calculation method for the surface roughness parameters that uses a confocal laser microscope, as described above. Furthermore, the surface roughness Sa of the skin-pass rolls is a parameter specified in JIS B 0681-2:2018, as described above. Furthermore, a roll diameter of the skin-pass rolls and a speed of the steel sheet during rolling are not particularly limited; for example, skin-pass rolls having a roll diameter of 800 to 900 mm is used, and the speed of the steel sheet is 40 to 50 mpm. Furthermore, during the skin-pass rolling, a tension may be applied to the steel sheet. The tension is not particularly limited. For example, the tension is 20 kgf/mm$^2$ or greater and 30 kgf/mm$^2$ or less.

Surface Roughness Sa of Skin-Pass Rolls: 0.06 μm or Less

If the surface roughness Sa of the skin-pass rolls is greater than 0.06 μm, the resulting roll transfer area of the surface of the steel sheet is coarse, and, consequently, the steel sheet resulting from the skin-pass rolling does not have high image clarity. Accordingly, the surface roughness Sa of the skin-pass rolls is specified to be less than or equal to 0.06 μm. It is preferable that the surface roughness Sa of the skin-pass rolls be as low as possible, and the lower limit is not particularly limited. For example, the surface roughness Sa of the skin-pass rolls may be specified to be greater than or equal to 0.01 μm, from the standpoint of costs and a polishing load.

Elongation Ratio for Skin-Pass Rolling: 0.10% or Greater and 3.00% or Less

If the elongation ratio for the skin-pass rolling is less than 0.10%, the resulting Sk and the Spk of the surface of the steel sheet are high, and, consequently, a desired image clarity cannot be achieved. On the other hand, if the elongation ratio for the skin-pass rolling is greater than 3.00%, the resulting Smr2 of the surface of the steel sheet is high, and, consequently, a desired whiteness cannot be achieved. Accordingly, the elongation ratio for the skin-pass rolling is specified to be 0.10% or greater and 3.00% or less. The skin-pass rolling may be performed in a single pass or multiple passes. In the instance where the skin-pass rolling is performed in multiple passes, the sum of the elongation ratios of the multiple passes is to be within the above-mentioned range. The elongation ratio for the skin-pass rolling (skin-pass elongation ratio (%)) is calculated according to the equation shown above.

The stainless steel sheet according to aspects of the present invention is suitably manufactured by any of the manufacturing methods described above. The stainless steel sheet according to aspects of the present invention may be any of the following stainless steel sheets: an austenitic stainless steel sheet, a ferritic-austenitic duplex stainless steel sheet, a ferritic stainless steel sheet, and a martensitic stainless steel sheet. In particular, ferritic stainless steel sheets and martensitic stainless steel sheets are advantageous because they eliminate the need to add one or more processes, such as polishing, to the common manufacturing processes, provided that each of the common manufacturing processes is carried out under appropriate conditions.

The austenitic stainless steel sheet or the ferritic-austenitic duplex stainless steel sheet has a microstructure, which may be a single-phase microstructure of an austenite phase, may be formed of a ferrite phase and an austenite phase, or may be formed of an austenite phase and a strain-induced martensite phase. The remainder, other than the ferrite phase, the austenite phase, or the strain-induced martensite phase, may or may not be inclusions and precipitates that are present in a volume fraction of 1% or less.

The ferritic stainless steel sheet or the martensitic stainless steel sheet have a microstructure, which may be a single-phase microstructure of a ferrite phase, a single-phase microstructure of a martensite phase, a composite microstructure of a ferrite phase and a martensite phase, a composite microstructure of a martensite phase and an austenite phase (in this case, the austenite phase is present in an area fraction of 10% or less), or a composite microstructure of a ferrite phase, a martensite phase, and an austenite phase (in this case, the austenite phase is present in an area fraction of 10% or less). The remainder, other than the ferrite phase, the martensite phase, or the austenite phase, may or may not be inclusions and precipitates that are present in a volume fraction of 5% or less. The inclusions and precipitates may be, for example, one or more selected from the group consisting of intermetallic compounds, carbides, nitrides, oxides, and sulfides. The identification of the phases can be carried out in accordance with a commonly used method.

EXAMPLES

Example 1

100 kg of a steel ingot was prepared by steelmaking from each of the steels having the chemical composition (the balance was Fe and incidental impurities) shown in Table 1. Subsequently, the steel ingot was heated at 1250° C. for 1 hour and subsequently subjected to hot rolling. In this manner, hot-rolled steel sheets having a sheet thickness of 3.5 mm were prepared. The hot-rolled steel sheets were subjected to hot-rolled sheet annealing in which the hot-rolled steel sheets were held at 1200° C. for 1 minute, to form hot-rolled annealed steel sheets. Subsequently, front and back surfaces of the hot-rolled annealed steel sheets were ground to remove scale. Subsequently, the hot-rolled annealed steel sheets were subjected to cold rolling in a cluster mill to form cold-rolled steel sheets having a sheet thickness of 1.0 mm. The produced cold-rolled steel sheets were held in an atmosphere of a mixture of hydrogen (25 vol %) and nitrogen (75 vol %) at 1100° C. for 1 minute. Accordingly, cold-rolled annealed steel sheets were produced and used as the material steel sheets.

The produced material steel sheets were dry polished with different grits of emery paper, shown in Table 2, to form cold-rolled, annealed, polished steel sheets (roughening step). The surface topography of the produced cold-rolled, annealed, polished steel sheets and the material steel sheets was measured with a confocal laser microscope VK 250/260, manufactured by Keyence Corporation, by using the method described above. Then, the surface roughness Sa was analyzed with a multi-file analysis application VK-H1XM, manufactured by Keyence Corporation, by using the method described above. For the measurement, the following measurement conditions were used: a 150× magnification objective lens was used, the upper and lower measurement limits and the brightness were automatically set, a real peak detection (RPD) method was used, and a height step size was 0.08 μm. The RPD method is a method in which measurements were performed with a specific height step size, and, from the data of laser light reflection intensity obtained for various heights, true focal heights are detected by calculations. For the removal of noise in the analysis, DCL correction with a threshold value of 5000 and spike removal correction with a high height-cut level were used. The determined surface roughness Sa of each of the test specimens is shown in Table 2. Note that for Test Nos. 1-18 and 1-25, the surface roughness Sa shown is that of the material steel sheet.

Subsequently, skin-pass rolling was performed, without application of tension, on the cold-rolled, annealed, polished steel sheets and the material steel sheets, with skin-pass rolls having the surface roughness Sa shown in Table 2, under conditions that could achieve the elongation ratios shown in Table 2; accordingly, cold-rolled, annealed, polished, skin-pass-finished steel sheets were produced (flattening step). Note that no skin-pass rolling was performed on Test Nos. 1-19 and 1-26.

The various surface parameters (Sk, Spk, and Smr2) of the produced steel sheets were evaluated with the measurement method and analysis method described above. The results are shown in Table 2.

Furthermore, the whiteness (i) and the image clarity (ii) of the produced steel sheets were measured with the methods described above and evaluated according to the following criteria. The evaluation results are shown in Table 2. The evaluation of the whiteness was performed with a CM-600d, manufactured by Konica Minolta, Inc.

(i) Whiteness

◎ (pass, excellent): 60 or greater

• (pass): 50 or greater and less than 60 x (fail): less than 50

(ii) Image clarity

◎ (pass, excellent): 10% or greater

• (pass): 1% or greater and less than 10% x (fail): less than 1%

TABLE 1

| | Chemical composition (mass %) | | | | | | | | | | |
|---|---|---|---|---|---|---|---|---|---|---|---|
| Steel type | C | Si | Mn | P | S | Ni | Cr | Al | N | Others | Notes |
| A | 0.054 | 0.41 | 0.76 | 0.007 | 0.005 | 8.33 | 18.0 | 0.005 | 0.025 | — | Austenitic |
| B | 0.014 | 0.33 | 2.91 | 0.029 | 0.001 | 1.95 | 21.1 | 0.032 | 0.166 | Cu: 1.04, V: 0.12 | Ferritic-austenitic duplex |

TABLE 2

| | | Roughening step | | Flattening step | | | | | | | |
|---|---|---|---|---|---|---|---|---|---|---|---|
| | | | Surface roughness Sa of test specimen resulting from | Surface roughness Sa of skin-pass | Skin-pass elongation | Surface roughness parameters | | | Evaluation results | | |
| Test No. | Steel type | Grit number | polishing (μm) | rolls (μm) | ratio (%) | Sk (μm) | Spk (μm) | Smr2 (%) | Whiteness | Image clarity | Notes |
| 1-1 | A | #400 | 0.572 | 0.028 | 0.92 | 0.464 | 0.098 | 58 | ◎ | ◎ | Invention example |
| 1-2 | A | #400 | 0.559 | 0.028 | 0.33 | 1.338 | 0.137 | 51 | ◎ | ○ | Invention example |
| 1-3 | A | #400 | 0.522 | 0.028 | 2.86 | 0.310 | 0.090 | 73 | ○ | ◎ | Invention example |
| 1-4 | A | #400 | 0.573 | 0.057 | 1.36 | 0.649 | 0.193 | 56 | ◎ | ○ | Invention example |
| 1-5 | A | #120 | 1.167 | 0.028 | 1.10 | 1.404 | 0.116 | 52 | ◎ | ○ | Invention example |
| 1-6 | A | #600 | 0.268 | 0.028 | 1.48 | 0.372 | 0.077 | 77 | ○ | ◎ | Invention example |
| 1-7 | B | #400 | 0.577 | 0.028 | 1.31 | 0.470 | 0.096 | 59 | ◎ | ◎ | Invention example |
| 1-8 | B | #400 | 0.551 | 0.028 | 1.36 | 1.447 | 0.146 | 54 | ◎ | ○ | Invention example |
| 1-9 | B | #400 | 0.545 | 0.028 | 1.12 | 0.280 | 0.090 | 71 | ○ | ◎ | Invention example |
| 1-10 | B | #400 | 0.560 | 0.057 | 1.21 | 0.625 | 0.187 | 55 | ◎ | ○ | Invention example |

TABLE 2-continued

| | | Roughening step | | Flattening step | | | | | | | |
|---|---|---|---|---|---|---|---|---|---|---|---|
| | | | Surface roughness Sa of test specimen resulting from | Surface roughness Sa of skin-pass | Skin-pass elongation | Surface roughness parameters | | | Evaluation results | | |
| Test No. | Steel type | Grit number | polishing (μm) | rolls (μm) | ratio (%) | Sk (μm) | Spk (μm) | Smr2 (%) | Whiteness | Image clarity | Notes |
| 1-11 | B | #120 | 1.176 | 0.028 | 1.12 | 1.424 | 0.122 | 53 | ◎ | ○ | Invention example |
| 1-12 | B | #600 | 0.257 | 0.028 | 1.06 | 0.362 | 0.073 | 78 | ○ | ◎ | Invention example |
| 1-13 | A | #400 | 0.567 | 0.028 | 0.05 | 1.687 | 0.164 | 50 | ◎ | X | Comparative example |
| 1-14 | A | #400 | 0.563 | 0.028 | 3.42 | 0.224 | 0.082 | 84 | X | ◎ | Comparative example |
| 1-15 | A | #400 | 0.559 | 0.085 | 0.96 | 0.667 | 0.297 | 66 | ○ | X | Comparative example |
| 1-16 | A | #800 | 0.156 | 0.028 | 0.48 | 0.337 | 0.254 | 79 | ○ | X | Comparative example |
| 1-17 | A | #800 | 0.156 | 0.028 | 0.90 | 0.271 | 0.186 | 83 | X | ○ | Comparative example |
| 1-18 | A | No polishing | 0.044*1 | 0.028 | 0.45 | 0.071 | 0.022 | 89 | X | ◎ | Comparative example |
| 1-19 | A | #400 | 0.564 | No skin-pass rolling | | 1.769 | 0.387 | 89 | ◎ | X | Comparative example |
| 1-20 | B | #400 | 0.579 | 0.028 | 0.03 | 1.772 | 0.171 | 51 | ◎ | X | Comparative example |
| 1-21 | B | #400 | 0.553 | 0.028 | 3.32 | 0.234 | 0.074 | 91 | X | ◎ | Comparative example |
| 1-22 | B | #400 | 0.534 | 0.085 | 1.00 | 0.645 | 0.274 | 74 | ○ | X | Comparative example |
| 1-23 | B | #800 | 0.155 | 0.028 | 0.52 | 0.332 | 0.250 | 78 | ○ | X | Comparative example |
| 1-24 | B | #800 | 0.154 | 0.028 | 0.91 | 0.293 | 0.197 | 83 | X | ○ | Comparative example |
| 1-25 | B | No polishing | 0.041*1 | 0.028 | 0.42 | 0.062 | 0.019 | 91 | X | ◎ | Comparative example |
| 1-26 | B | #400 | 0.532 | No skin-pass rolling | | 1.757 | 0.378 | 88 | ◎ | X | Comparative example |

The underline indicates "falling outside the scope of the present invention".
*1The value shown is the surface roughness Sa of the material steel sheet.

As shown in Table 2, the required properties of (i) and (ii), described above, were satisfied in all of the Invention Examples.

In contrast, at least one of the required properties of (i) and (ii), described above, was not satisfied in all of the Comparative Examples, Specifically, in the Comparative Examples of Test Nos. 1-13 and 1-20, the skin-pass elongation ratio was less than the appropriate range, and as a result, the Sk was high, and the image clarity was less than 1%.

In the Comparative Examples of Test Nos. 1-14 and 1-21, the skin-pass elongation ratio was greater than the appropriate range, and as a result, the Smr2 was high, and the whiteness was less than 50.

In the Comparative Examples of Test Nos. 1-15 and 1-22, the surface roughness Sa of the skin-pass rolls was greater than the appropriate range, and as a result, the Spk was high, and the image clarity was less than 1%.

In the Comparative Examples of Test Nos. 1-16 and 1-23, the surface roughness Sa of the test specimens resulting from the polishing was less than the appropriate range, and the skin-pass elongation ratio was relatively low, and as a result, the Spk was high, and the image clarity was less than 1%.

In the Comparative Examples of Test Nos. 1-17 and 1-24, the surface roughness Sa of the test specimens resulting from the polishing was less than the appropriate range, and the skin-pass elongation ratio was relatively high, and as a result, the Smr2 was high, and the whiteness was less than 50.

In the Comparative Examples of Test Nos. 1-18 and 1-25, the roughening treatment was not performed, and as a result, the Smr2 was high, and the whiteness was less than 50.

In the Comparative Examples of Test Nos. 1-19 and 1-26, the flattening treatment was not performed, and as a result, the Sk and the Spk were both high, and the image clarity was less than 1%.

Example 2

100 kg of a steel ingot was prepared by steelmaking from each of the steels having the chemical composition (the balance was Fe and incidental impurities) shown in Table 3. Subsequently, the steel ingot was heated at 1200° C. for 1 hour and subsequently subjected to hot rolling. In this manner, hot-rolled steel sheets having a sheet thickness of 3.5 mm were prepared. The hot-rolled steel sheets were subjected to hot-rolled sheet annealing, in which Steel C, Steel D, and Steel G were held at 800° C. for 8 hours, Steel E and Steel H were held at 950° C. for 1 minute, and Steel F was held at 1050° C. for 2 minutes, to form hot-rolled annealed steel sheets. Subsequently, front and back surfaces of the hot-rolled annealed steel sheets were ground to remove scale. Subsequently, the hot-rolled annealed steel sheets were subjected to cold rolling in a cluster mill to form cold-rolled steel sheets having a sheet thickness of 1.0 mm. These cold-rolled steel sheets were used as the material steel sheets.

The produced material steel sheets were heat-treated (annealed) under the conditions shown in Table 4 and subsequently pickled by being immersed in an aqueous solution of sulfuric acid under the conditions shown in Table 4. Subsequently, much of the smut was removed from the surface by rubbing the surface with absorbent cotton while a water stream was applied thereto. Subsequently, the steel sheets were immersed in a mixed aqueous solution of 2 mass % hydrofluoric acid and 10 mass % nitric acid for 3 seconds, and subsequently, the smut was completely removed from the surface by rubbing the surface with absorbent cotton while a water stream was applied thereto (roughening step). Note that, in the treatment of the immersion in the mixed aqueous solution, the pickling weight loss was confirmed to be not greater than 5 g/m$^2$.

Subsequently, skin-pass rolling was performed with skin pass-rolls having the surface roughness Sa shown in Table 4, under conditions that could achieve the elongation ratios shown in Table 4; accordingly, cold-rolled, annealed, pickled, skin-pass-finished steel sheets were produced (flattening step). Note that no skin-pass rolling was performed on Test Nos. 2-24 and 2-34.

The various surface parameters (Sk, Spk, and Smr2) of the produced steel sheets were evaluated with the methods described above. The results are shown in Table 4.

Furthermore, the whiteness (i) and the image clarity (ii) of the produced steel sheets were evaluated with the same method and criteria as those of Example 1. The evaluation results are shown in Table 4.

TABLE 3

| Steel | Chemical composition (mass %) | | | | | | | | | | |
|---|---|---|---|---|---|---|---|---|---|---|---|
| type | C | Si | Mn | P | S | Ni | Cr | Al | N | Others | Notes |
| C | 0.042 | 0.22 | 0.53 | 0.025 | 0.003 | 0.12 | 16.2 | 0.002 | 0.049 | — | Ferritic |
| D | 0.313 | 0.45 | 0.43 | 0.018 | 0.004 | 0.24 | 13.2 | 0.002 | 0.016 | — | Martensitic |
| E | 0.008 | 0.12 | 0.15 | 0.031 | 0.002 | 0.15 | 17.5 | 0.033 | 0.008 | Ti: 0.31 | Ferritic |
| F | 0.004 | 0.32 | 0.11 | 0.027 | 0.001 | 0.19 | 19.1 | 0.019 | 0.008 | Mo: 1.89, Nb: 0.36 | Ferritic |
| G | 0.073 | 0.30 | 1.57 | 0.022 | 0.005 | 0.01 | 12.1 | 0.003 | 0.013 | Co: 0.13, W: 0.15, B: 0.0006, Ca: 0.0009, Ce: 0.04, Y: 0.03 | Martensitic |
| H | 0.005 | 0.14 | 0.07 | 0.021 | 0.002 | 0.14 | 20.3 | 5.761 | 0.003 | Mg: 0.0011, La: 0.12, Sn: 0.06, Sb: 0.05 | Ferritic |

TABLE 4

| | | Roughening step | | | | | Flattening step | | | | | | | |
|---|---|---|---|---|---|---|---|---|---|---|---|---|---|---|
| | | Heat treatment process | | Pickling process | | | | | Surface roughness parameters | | | Evaluation results | | |
| Test No. | Steel type | Holding temperature (° C.) | Holding time (min) | Temperature of sulfuric acid (° C.) | Concentration of sulfuric acid (mass %) | Time of immersion (s) | Surface roughness Sa of skin-pass rolls (μm) | Skin-pass elongation ratio (%) | Sk (μm) | Spk (μm) | Smr2 (%) | Whiteness | Image clarity | Notes |
| 2-1 | C | 830 | 480 | 85 | 22 | 60 | 0.034 | 1.31 | 0.399 | 0.065 | 60 | ◎ | ◎ | Invention example |
| 2-2 | C | 760 | 200 | 76 | 16 | 32 | 0.034 | 2.72 | 0.348 | 0.058 | 72 | ○ | ◎ | Invention example |
| 2-3 | C | 845 | 590 | 93 | 29 | 235 | 0.034 | 0.33 | 0.847 | 0.133 | 59 | ◎ | ○ | Invention example |
| 2-4 | D | 830 | 480 | 85 | 22 | 60 | 0.034 | 1.38 | 0.416 | 0.058 | 59 | ◎ | ◎ | Invention example |
| 2-5 | D | 755 | 480 | 85 | 22 | 60 | 0.034 | 2.88 | 0.379 | 0.062 | 74 | ○ | ◎ | Invention example |
| 2-6 | D | 840 | 480 | 85 | 22 | 60 | 0.034 | 0.18 | 1.090 | 0.139 | 57 | ◎ | ○ | Invention example |
| 2-7 | E | 830 | 480 | 85 | 22 | 60 | 0.034 | 1.25 | 0.405 | 0.062 | 60 | ◎ | ◎ | Invention example |
| 2-8 | E | 770 | 480 | 85 | 22 | 60 | 0.034 | 2.96 | 0.343 | 0.061 | 75 | ○ | ◎ | Invention example |
| 2-9 | E | 850 | 480 | 85 | 22 | 60 | 0.034 | 0.52 | 0.828 | 0.116 | 59 | ◎ | ○ | Invention example |
| 2-10 | F | 830 | 480 | 85 | 22 | 60 | 0.034 | 1.36 | 0.397 | 0.062 | 60 | ◎ | ◎ | Invention example |
| 2-11 | F | 750 | 480 | 85 | 22 | 60 | 0.034 | 2.71 | 0.360 | 0.056 | 70 | ○ | ◎ | Invention example |
| 2-12 | F | 830 | 480 | 85 | 22 | 60 | 0.034 | 0.31 | 0.638 | 0.104 | 58 | ◎ | ○ | Invention example |
| 2-13 | G | 830 | 480 | 85 | 22 | 60 | 0.034 | 1.28 | 0.423 | 0.060 | 59 | ◎ | ◎ | Invention example |

TABLE 4-continued

| | | Roughening step | | | | | Flattening step | | | | | | | |
|---|---|---|---|---|---|---|---|---|---|---|---|---|---|---|
| | | Heat treatment process | | Pickling process | | | | | | | | | | |
| Test No. | Steel type | Holding temperature (° C.) | Holding time (min) | Temperature of sulfuric acid (° C.) | Concentration of sulfuric acid (mass %) | Time of immersion (s) | Surface roughness Sa of skin-pass rolls (μm) | Skin-pass elongation ratio (%) | Surface roughness parameters Sk (μm) | Spk (μm) | Smr2 (%) | Evaluation results Whiteness | Image clarity | Notes |
| 2-14 | G | 770 | 480 | 85 | 22 | 60 | 0.034 | 2.93 | 0.344 | 0.055 | 73 | ○ | ◎ | Invention example |
| 2-15 | H | 830 | 480 | 85 | 22 | 60 | 0.034 | 1.26 | 0.412 | 0.064 | 60 | ◎ | ◎ | Invention example |
| 2-16 | H | 850 | 480 | 85 | 22 | 60 | 0.034 | 0.13 | 1.306 | 0.156 | 55 | ◎ | ○ | Invention example |
| 2-17 | C | 720 | 480 | 85 | 22 | 60 | 0.034 | 1.31 | 0.198 | 0.067 | 82 | X | ◎ | Comparative example |
| 2-18 | D | 930 | 480 | 85 | 22 | 60 | 0.034 | 1.18 | 0.243 | 0.054 | 81 | X | ◎ | Comparative example |
| 2-19 | C | 830 | 125 | 85 | 22 | 60 | 0.034 | 1.39 | 0.210 | 0.051 | 82 | X | ◎ | Comparative example |
| 2-20 | D | 830 | 480 | 70 | 22 | 60 | 0.034 | 0.91 | 0.219 | 0.058 | 83 | X | ◎ | Comparative example |
| 2-21 | C | 830 | 480 | 85 | 12 | 60 | 0.034 | 1.33 | 0.228 | 0.043 | 84 | X | ◎ | Comparative example |
| 2-22 | D | 830 | 480 | 85 | 22 | 25 | 0.034 | 1.21 | 0.245 | 0.054 | 81 | X | ◎ | Comparative example |
| 2-23 | C | 830 | 480 | 85 | 22 | 60 | 0.095 | 1.05 | 0.820 | 0.253 | 69 | ○ | X | Comparative example |
| 2-24 | D | 830 | 480 | 85 | 22 | 60 | No skin-pass rolling | | 1.848 | 0.415 | 94 | ◎ | X | Comparative example |
| 2-25 | C | 830 | 480 | 85 | 22 | 60 | 0.034 | 0.06 | 1.737 | 0.152 | 70 | ○ | X | Comparative example |
| 2-26 | D | 830 | 480 | 85 | 22 | 60 | 0.034 | 3.44 | 0.253 | 0.079 | 85 | X | ◎ | Comparative example |
| 2-27 | E | 720 | 480 | 85 | 22 | 60 | 0.034 | 1.27 | 0.183 | 0.062 | 85 | X | ◎ | Comparative example |
| 2-28 | F | 930 | 480 | 85 | 22 | 60 | 0.034 | 1.26 | 0.237 | 0.052 | 84 | X | ◎ | Comparative example |
| 2-29 | E | 830 | 1 | 85 | 22 | 60 | 0.034 | 1.35 | 0.199 | 0.052 | 82 | X | ◎ | Comparative example |
| 2-30 | F | 830 | 480 | 70 | 22 | 60 | 0.034 | 0.90 | 0.220 | 0.054 | 85 | X | ◎ | Comparative example |
| 2-31 | E | 830 | 480 | 85 | 12 | 60 | 0.034 | 1.27 | 0.216 | 0.045 | 83 | X | ◎ | Comparative example |
| 2-32 | F | 830 | 480 | 85 | 22 | 25 | 0.034 | 1.27 | 0.226 | 0.053 | 81 | X | ◎ | Comparative example |
| 2-33 | E | 830 | 480 | 85 | 22 | 60 | 0.095 | 0.99 | 0.755 | 0.260 | 70 | ○ | X | Comparative example |
| 2-34 | F | 830 | 480 | 85 | 22 | 60 | No skin-pass rolling | | 1.791 | 0.392 | 91 | ◎ | X | Comparative example |
| 2-35 | E | 830 | 480 | 85 | 22 | 60 | 0.034 | 0.05 | 1.574 | 0.143 | 73 | ○ | X | Comparative example |
| 2-36 | F | 830 | 480 | 85 | 22 | 60 | 0.034 | 3.78 | 0.247 | 0.075 | 82 | X | ◎ | Comparative example |

The underline indicates "falling outside the scope of the present invention".

As shown in Table 4, the required properties of (i) and (ii), described above, were satisfied in all of the Invention Examples.

In contrast, at least one of the required properties of (i) and (ii), described above, was not satisfied in all of the Comparative Examples, Specifically, in the Comparative Examples of Test Nos. 2-17 and 2-27, the annealing temperature for the cold-rolled steel sheet was less than the appropriate range, and as a result, the Smr2 was high, and the whiteness was less than 50.

In the Comparative Examples of Test Nos. 2-18 and 2-28, the annealing temperature for the cold-rolled steel sheet was greater than the appropriate range, and as a result, the Smr2 was high, and the whiteness was less than 50.

In the Comparative Examples of Test Nos. 2-19 and 2-29, the annealing time for the cold-rolled steel sheet was less than the appropriate range, and as a result, the Smr2 was high, and the whiteness was less than 50.

In the Comparative Examples of Test Nos. 2-20 and 2-30, the temperature of the aqueous solution of sulfuric acid used in the pickling of the cold-rolled annealed steel sheet was less than the appropriate range, and as a result, the Smr2 was high, and the whiteness was less than 50.

In the Comparative Examples of Test Nos. 2-21 and 2-31, the concentration of the aqueous solution of sulfuric acid used in the pickling of the cold-rolled annealed steel sheet was less than the appropriate range, and as a result, the Smr2 was high, and the whiteness was less than 50.

In the Comparative Examples of Test Nos. 2-22 and 2-32, the time of immersion for the pickling of the cold-rolled annealed steel sheet was less than the appropriate range, and as a result, the Smr2 was high, and the whiteness was less than 50.

In the Comparative Examples of Test Nos. 2-23 and 2-33, the surface roughness Sa of the skin-pass rolls was greater than the appropriate range, and as a result, the Spk was high, and the image clarity was less than 1%.

In the Comparative Examples of Test Nos. 2-24 and 2-34, the flattening treatment was not performed, and as a result, the Sk and the Spk were both high, and the image clarity was less than 1%.

In the Comparative Examples of Test Nos. 2-25 and 2-35, the skin-pass elongation ratio was less than the appropriate range, and as a result, the Sk was high, and the image clarity was less than 1%.

In the Comparative Examples of Test Nos. 2-26 and 2-36, the skin-pass elongation ratio was greater than the appropriate range, and as a result, the Smr2 was high, and the whiteness was less than 50.

INDUSTRIAL APPLICABILITY

The stainless steel sheet according to aspects of the present invention is suitable for use in corrosion resistant members that are required to have a soft color, such as inner panels of elevators, sink worktops, and interiors.

The invention claimed is:

1. A stainless steel sheet comprising a surface quality in which a core height Sk is 1.50 μm or less, a reduced peak height Spk is 0.20 μm or less, and an areal material ratio Smr2 that separates a reduced dale from a core is 80% or less, where the core height Sk, the reduced peak height Spk, and the areal material ratio Smr2 are as specified in JIS B 0681-2:2018, wherein the stainless steel sheet has a whiteness of 50 or greater and an image clarity of 1% or greater.

2. A method for manufacturing the stainless steel sheet according to claim 1, wherein the stainless steel sheet is an austenitic stainless steel sheet or a ferritic-austenitic duplex stainless steel sheet, the method comprising:

a material steel sheet providing step including providing a cold-rolled annealed steel sheet that serves as a material;

a roughening step including polishing the cold rolled annealed steel sheet to produce a cold-rolled, annealed, polished steel sheet; and a flattening step including subjecting the cold-rolled, annealed, polished steel sheet to skin-pass rolling to produce a cold-rolled, annealed, polished, skin-pass-finished steel sheet, wherein in the roughening step, the cold-rolled annealed steel sheet is subjected to a polishing treatment in which a surface roughness Sa of the cold-rolled annealed steel sheet is adjusted to be 0.20 μm or greater and 2.00 μm or less, and in the flattening step, the cold-rolled, annealed, polished steel sheet is subjected to skin-pass rolling that is performed at an elongation ratio of 0.10% or greater and 3.00% or less by using a skin-pass roll having a surface roughness Sa of 0.06 μm or less.

3. A method for manufacturing the stainless steel sheet according to claim 1, wherein the stainless steel sheet is a ferritic stainless steel sheet or a martensitic stainless steel sheet, the method comprising:

a material steel sheet providing step including providing a cold-rolled steel sheet that serves as a material;

a roughening step including heat-treating the cold-rolled steel sheet to form a cold-rolled annealed steel sheet and then pickling the cold rolled annealed steel sheet to produce a cold-rolled, annealed, pickled steel sheet; and a flattening step including subjecting the cold-rolled, annealed, pickled steel sheet to skin-pass rolling to produce a cold-rolled, annealed, pickled, skin-pass-finished steel sheet, wherein in the roughening step, the cold-rolled steel sheet is subjected to a heat treatment in which the cold-rolled steel sheet is held in a temperature range of 750° C. or greater and 850° C. or less for 3 hours or more and 10 hours or less, to form a cold-rolled annealed steel sheet, and subsequently, the cold-rolled annealed steel sheet is subjected to pickling in which the cold-rolled annealed steel sheet is immersed in an aqueous solution of sulfuric acid having a concentration of 15 mass % or greater and 30 mass % or less and having a temperature of 75° C. or greater and 95° C. or less, for 30 seconds or more and 240 seconds or less and in the flattening step, the cold-rolled, annealed, pickled steel sheet is subjected to skin-pass rolling that is performed at an elongation ratio of 0.10% or greater and 3.00% or less by using a skin-pass roll having a surface roughness Sa of 0.06 μm or less.

* * * * *